US011828508B2

(12) United States Patent
Jovet et al.

(10) Patent No.: US 11,828,508 B2
(45) Date of Patent: Nov. 28, 2023

(54) COMBINED CHILLER AND FREE COOLING SYSTEM FOR OPERATION AT HIGH AMBIENT TEMPERATURE

(71) Applicant: LGL France S.A.S., Mions (FR)

(72) Inventors: Bastien Jovet, Peisey-Nancroix (FR); Eric Chapuis, Saint Priest (FR)

(73) Assignee: LGL France S.A.S., Mions (FR)

( * ) Notice: Subject to any disclaimer, the term of this patent is extended or adjusted under 35 U.S.C. 154(b) by 124 days.

(21) Appl. No.: 17/216,257

(22) Filed: Mar. 29, 2021

(65) Prior Publication Data

US 2022/0307747 A1 Sep. 29, 2022

(51) Int. Cl.

| | |
|---|---|
| ***F25B 49/02*** | (2006.01) |
| ***F25B 41/20*** | (2021.01) |
| ***F25B 13/00*** | (2006.01) |

(52) U.S. Cl.

CPC ..... *F25B 49/02* (2013.01); *F25B 13/00* (2013.01); *F25B 41/20* (2021.01)

(58) Field of Classification Search

CPC ..... F25B 13/00; F25B 2700/2106; F25B 49/02; F25B 41/20; F25B 25/005; F25B 2339/047; F24F 11/84; F24F 11/30; F24F 11/87

USPC ..... 62/DIG. 22

See application file for complete search history.

(56) References Cited

U.S. PATENT DOCUMENTS

| | | | | |
|---|---|---|---|---|
| 10,782,034 B2 | 9/2020 | Peck | | |
| 2018/0120005 A1* | 5/2018 | Kopko | ..... | F25D 16/00 |
| 2019/0101314 A1* | 4/2019 | Muthusubramanian | ..... | F25B 49/022 |
| 2020/0018529 A1 | 1/2020 | Schreiber et al. | | |
| 2021/0102726 A1* | 4/2021 | Bush | ..... | F25B 30/02 |

FOREIGN PATENT DOCUMENTS

| | | | | |
|---|---|---|---|---|
| EP | 3351862 A1 | 7/2018 | | |
| JP | 2008281219 A | * 11/2008 | | |
| JP | 2014134321 A | * 7/2014 | | |
| WO | WO-2008076120 A1 | * 6/2008 | ..... | F25B 25/00 |

(Continued)

OTHER PUBLICATIONS

JP-2008281219-A English Translation (Year: 2008).*

(Continued)

*Primary Examiner* — David J Teitelbaum
*Assistant Examiner* — Devon Moore
(74) *Attorney, Agent, or Firm* — Baker Botts L.L.P.

(57) ABSTRACT

A system includes a first set of coils that receive coolant from a first coolant line and provide the coolant to a second coolant line. A second set of coils that receive coolant from a third coolant line and provide the coolant to a fourth coolant line. A first valve regulates flow of coolant between the first and third coolant line. A second valve regulates flow of coolant between the second and the fourth coolant lines. A third valve regulates flow of coolant between the fourth coolant line and a fifth coolant line coupled to a water evaporator and a three-way valve. The three-way valve regulates flow of coolant between the fifth coolant line, the third coolant line, and a coolant input line. A fourth valve regulates flow of coolant between the second coolant line and a water condenser. A controller adjusts the valves to operate in a high temperature mode.

20 Claims, 11 Drawing Sheets

(56) References Cited

FOREIGN PATENT DOCUMENTS

| | | | | |
|---|---|---|---|---|
| WO | WO-2017203317 A1 * | 11/2017 | ..... | F25B 25/005 |
| WO | WO-2020247154 A1 * | 12/2020 | ..... | F25B 13/00 |

OTHER PUBLICATIONS

JP-2014134321-A English Translation (Year: 2014).*
Jovet, B. et al., "Combined Chiller and Free Cooling System for Operation at Low Ambient Temperature," U.S. Appl. No. 17/216,337, filed Mar. 29, 2021, 52 pages.
Jovet, B. et al., "Combined Chiller and Free Cooling System for Operation at Intermediate Ambient Temperature," U.S. Appl. No. 17/216,388, filed Mar. 29, 2021, 53 pages.
Extended European Search Report, Application No. 22156605.2, dated Jul. 22, 2022.

* cited by examiner

COMBINED CHILLER AND FREE COOLING SYSTEM FOR OPERATION AT HIGH AMBIENT TEMPERATURE

TECHNICAL FIELD

This disclosure relates generally to heating, ventilation, and air conditioning (HVAC) systems and methods of their use. More particularly, in certain embodiments, this disclosure relates to a combined chiller and free cooling system for operation at high ambient temperature.

BACKGROUND

Chiller systems may be used in cooling air for relatively large spaces, such as commercial buildings, industries, schools, data centers, and the like. A chiller system may cool a refrigerant by transferring heat to outdoor air. The cooled refrigerant is then used to cool a flow of coolant, which is delivered to an indoor system in order to cool air that is provided to the space.

SUMMARY OF THE DISCLOSURE

As described above, a chiller system cools a flow of refrigerant, through a refrigeration cycle involving heat transfer with outdoor air and uses this cooled refrigerant to cool a flow of coolant. The coolant is then delivered to an indoor unit to cool air that is provided to an enclosed, or indoor, space. In some cases, the outdoor ambient temperature is sufficiently low for the coolant to be directly cooled by the air without requiring the refrigeration cycle of a typical chiller. Such direct cooling at relatively low ambient temperatures may be referred to as "free cooling." Free cooling may be available in spaces that still have a cooling demand even when the outdoor temperature is relatively low, such as offices with high internal loads like computer rooms, data centers, and the like. For example, free cooling may particularly be available in locations where outdoor air temperatures are below 5° C. for a significant portion of each year.

Generally, in order to implement free cooling in previous systems, a free cooling unit must be added to a chiller unit (e.g., via retrofitting of an existing chiller unit). This can result in various disadvantages and inefficiencies. In particular, the use of a separate chiller unit and free cooling unit results in the inefficient use of heat transfer area because condensers of one unit will always be inactive. For example, when the outdoor ambient temperature is relatively high, the chiller unit may be operated, while the heat transfer resources (e.g., the heat transfer coils) of the free cooling unit are unused. Similarly, during low outdoor temperature conditions, the free cooler unit may be operated, while the condensers of the chiller are idle or not used. Furthermore, when a separate chiller unit and free cooling unit are combined, human error can occur, resulting in increased likelihood of system faults and the corresponding downtimes during which cooling is unavailable. This may be particularly problematic when the chiller unit and free cooling unit are manufactured by different entities, or when the units are not expressly designed to be operated in combination.

This disclosure contemplates an unconventional system that solves problems of previous chiller systems, including those described above. The system, in certain embodiments, includes a combined chiller/free cooling unit. This unit includes outdoor coils arranged in parallel, such that a first-side inlet of each coil is in fluid communication with a first-side coolant line and a second-side outlet of each coil is in fluid communication with the same second-side coolant line. A first valve is located in the first-side coolant line and a second valve is located in the second-side coolant line to separate the coils into a first set of coils on one side of the first and second valves and a second set of coils on the other side of the first and second valves. A third valve may be positioned to regulate the flow of coolant from the second-side coolant line (on the side of the second set of coils) toward a water evaporator. A fourth valve may be positioned to regulate a flow of coolant from the second-side coolant line (on the side of the first set of coils) to a water condenser.

These specially arranged valves are controlled by a controller, which is configured to operate the unit in an appropriate mode based, for instance, on environmental and/or setpoint conditions. For example, in a high-temperature operating mode, the first, second, and fourth valves may be adjusted to an open position, while the third valve is adjusted to a closed position. This valve configuration corresponds to both the first and second sets of coils acting as chillers (e.g., where cooling is facilitated via contact with a refrigerant undergoing a vapor compression refrigeration cycle). In a low temperature operating mode, the first, second, and third valves are adjusted to open positions, while the fourth valve is adjusted to a closed position. This valve configuration corresponds to both the first and second sets of coils acting as a free cooling unit (e.g., where cooling is facilitated through heat transfer with cool outdoor air). In an intermediate-temperature operating mode, the third and fourth valves are adjusted to open positions, while the first and second valves are adjusted to a closed position. This valve configuration corresponds to the first set of coils acting as chillers (e.g., where cooling is facilitated via contact with a refrigerant undergoing a vapor compression refrigeration cycle) and the second sets of coils acting as a free cooling unit (e.g., where cooling is facilitated through heat transfer with cool outdoor air).

The combined chiller/free cooling unit described in this disclosure allows the full (i.e., entire) heat transfer area of the unit to be used under all operating conditions, such that cooling resources are not wasted, left unused, or otherwise left idle during portions of the year. The combined chiller/free cooling unit improves the efficiency of providing cooling to a space by ensuring that an efficient combination of refrigerant-based cooling (i.e., cooling involving a refrigeration cycle) and/or free cooling (i.e., cooling provided directly from a cool ambient environment) are selected. For example, a controller of the combined chiller/free cooling unit may operate in one of several modes for improving cooling efficiency. For instance, at a high ambient temperature, valves may be adjusted to operate the combined chiller/free cooling unit in a high temperature mode where both the first and second sets of coils are configured for refrigerant-based cooling (se FIG. 2). Meanwhile, at a low ambient outdoor temperature the controller may adjust valves of the combined chiller/free cooling unit such both first and second sets of coils are configured for free cooling (see FIG. 3). At intermediate ambient temperatures, the controller operates the unit in a mode in which cooling is provided by both refrigerant-based cooling and the free cooling (see FIG. 4). In some embodiments, a plurality of valves are positioned and configured such that heat transfer resources (e.g., the various coils) can be redistributed amongst the refrigerant-based cooling portion and the free cooling portion, further increasing the overall efficiency of cooling operations (see FIG. 5). The combined chiller/free cooling unit of this disclosure may allow free cooling to be used at higher ambient temperatures than was possible using previous technology by supplementing free cooling with refrigerant-based cooling.

Certain embodiments may include none, some, or all of the above technical advantages. One or more other technical advantages may be readily apparent to one skilled in the art from the figures, descriptions, and claims included herein.

In an embodiment, a system includes a first set of coils configured to receive coolant from a first coolant line, transfer heat from the coolant to outdoor air, and provide the coolant to a second coolant line. A second set of coils is configured to receive coolant from a third coolant line, transfer heat from the coolant to outdoor air, and provide the coolant to a fourth coolant line. A first valve is positioned and configured to regulate flow of the coolant between the first coolant line and the third coolant line. A second valve is positioned and configured to regulate flow of the coolant between the second coolant line and the fourth coolant line. A third valve is positioned and configured to regulate flow of coolant between the fourth coolant line and a fifth coolant line. The fifth coolant line is coupled to a water evaporator and a three-way valve. The three-way valve is configured to regulate flow of the coolant between the fifth coolant line, the third coolant line, and a coolant input line. A fourth valve is positioned and configured to regulate flow of the coolant between the first coolant line and a water condenser. A compressor is configured to compress a refrigerant provided to the water condenser.

In another embodiment, a controller (e.g., of the system described in the embodiment above) receives an outdoor temperature and an indoor setpoint temperature. The controller determines, based on a comparison of the outdoor temperature to the indoor setpoint temperature, that the system should operate in a high-temperature operating mode. After determining that the system should operate in the high-temperature operating mode, the first valve is caused to be in an open position such that flow of the coolant is allowed between the first coolant line and the third coolant line. The second valve is caused to be in the open position such that flow of the coolant is allowed between the second coolant line and the fourth coolant line. The third valve is caused to be in a closed position such that flow of the coolant is prevented between the fourth coolant line and the fifth coolant line. The fourth valve is caused to be in the open position such that flow of the coolant is allowed between the second coolant line and the water condenser. The three-way valve is caused to be in a position such that flow of the coolant is allowed between the coolant input and the fifth coolant line and prevented between the coolant input and the third coolant line.

In another embodiment, a controller (e.g., of the system described in the embodiment above) receives a temperature measurement and an indoor setpoint temperature. The controller determines, based on a comparison of the temperature measurement to the indoor setpoint temperature, that the system should operate in a low-temperature operating mode. After determining that the system should operate in the low-temperature operating mode, the first valve is caused to be in an open position such that flow of the coolant is allowed between the first coolant line and the third coolant line. The second valve is caused to be in the open position such that flow of the coolant is allowed between the second coolant line and the fourth coolant line. The third valve is caused to be in the open position such that flow of the coolant is allowed between the fourth coolant line and the fifth coolant line. The fourth valve is caused to be in a closed position such that flow of the coolant is prevented between the second coolant line and the water condenser. The three-way valve is caused to be in a position such that flow of the coolant is allowed between the coolant input and the third coolant line and prevented between the fifth coolant line and the third coolant line.

In yet another embodiment, a controller (e.g., of the system described in the embodiment above) receives a temperature measurement and an indoor setpoint temperature. The controller determines, based on a comparison of the temperature measurement to the indoor setpoint temperature, that the system should operate in an intermediate-temperature operating mode. After determining that the system should operate in the intermediate-temperature operating mode, the first valve is caused to be in a closed position such that flow of the coolant is prevented between the first coolant line and the third coolant line. The second valve is caused to be in the closed position such that flow of the coolant is prevented between the second coolant line and the fourth coolant line. The third valve is caused to be in an open position such that flow of the coolant is allowed between the fourth coolant line and the fifth coolant line. The fourth valve is caused to be in the open position such that flow of the coolant is allowed between the second coolant line and the water condenser. The three-way valve is caused to be in a position such that flow of the coolant is allowed between the coolant input and the third coolant line and prevented between the fifth coolant line and the third coolant line.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 12 of the drawings, like numerals being used for like and corresponding parts of the various drawings.

Figure 1:
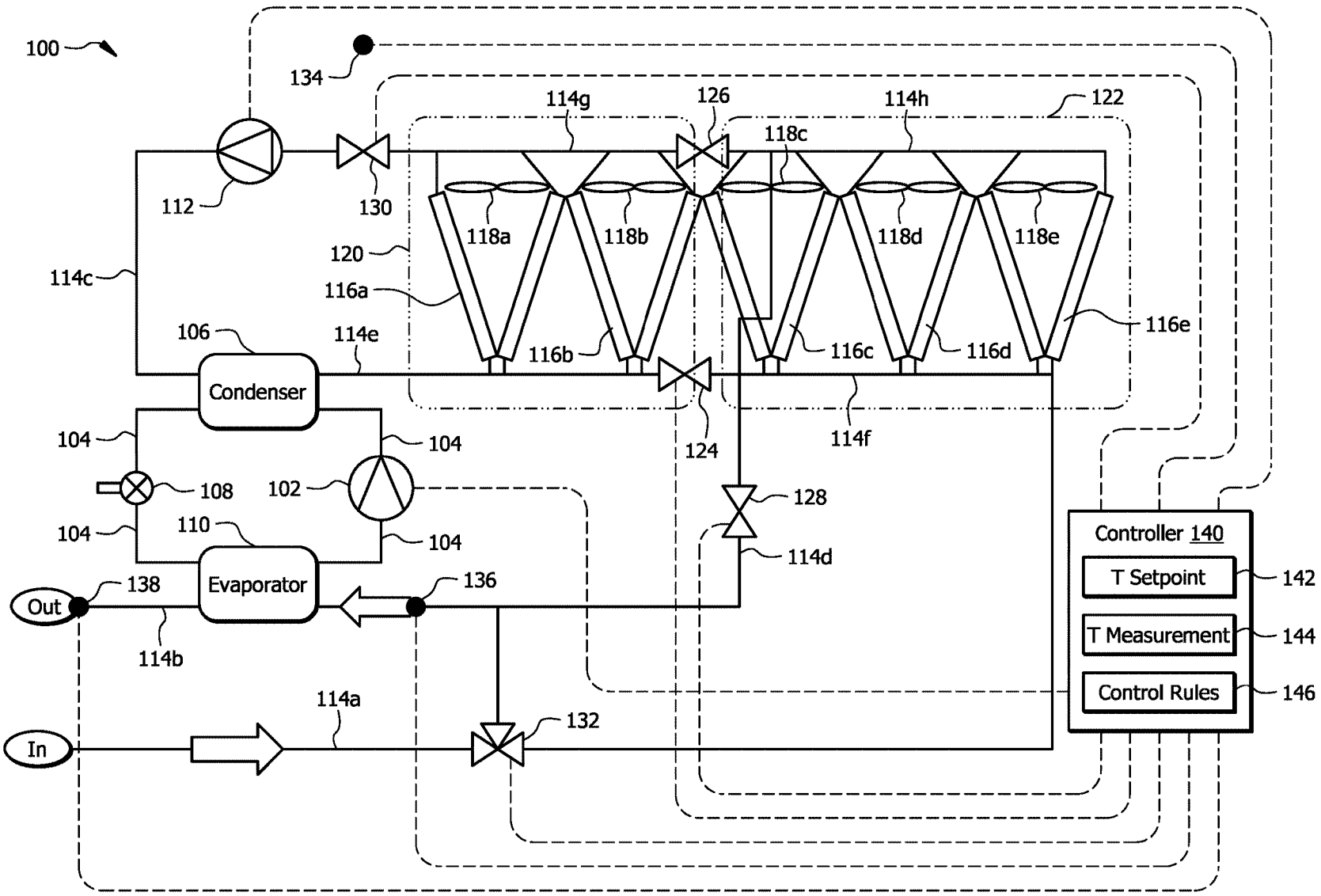
FIG. 1 is a diagram of an example combined chiller/free cooling system.

FIG. 1 is a schematic diagram of an embodiment of a chiller/free cooling system 100. The chiller/free cooling system 100 generally receives heated coolant at fluid conduit 114*a*, cools this coolant, and provides the cooled coolant via fluid conduit 114*b*. The heated coolant may be received from an indoor unit (not shown for clarity and conciseness) that conditions air for delivery to a conditioned space or otherwise provides cooling to an indoor space or an industrial process. The conditioned space may be, for example, a room, a house, an office building, a warehouse, or the like. In some embodiments, the chiller/free cooling system 100 may be, or may be part of, a rooftop unit (RTU) that is positioned on the roof of a building and the conditioned air is delivered to the interior of the building. In other embodiments, portions of the chiller/free cooling system 100 may be located within the building and a portion outside the building. The chiller/free cooling system 100 may include other elements that are not shown here for convenience and clarity. The chiller/free cooling system 100 may be configured as shown in FIG. 1 or in any other suitable configuration. For example, the chiller/free cooling system 100 may include additional components or may omit one or more components shown in FIG. 1.

The chiller/free cooling system 100 includes a compressor 102, a working fluid conduit subsystem 104, a condenser 106, an expansion device 108, an evaporator 110, a coolant pump 112, a coolant conduit subsystem 114*a-f*, a first set of coils 120, a second set of coils 122, a first valve 124, a second valve 126, a third valve 128, a fourth valve 130, a three-way valve 132, one or more sensors 134, 136, 138, and a controller 140.

The compressor 102, working fluid conduit subsystem 104, expansion device 108, condenser 106, and evaporator 110 operate to facilitate an expansion-compression cycle of working fluid flowing therethrough. In general, the compressor 102 compresses a working fluid (e.g., refrigerant or other fluid) that is provided to the condenser 106 where the working fluid is cooled via heat transfer with the coolant from conduit 114*c*. The cooled working fluid is provided along conduit 104 through expansion device 108 before the working fluid is provided to the evaporator 110. At the evaporator 110, heat is transferred from the coolant flowing in conduit 114*d* to the working fluid, such that the coolant is cooled before being provided to conduit 114*b* for indoor cooling. The coolant may be any appropriate coolant fluid, such as water or a mixture of water and glycol.

The compressor 102 may be a single-stage or multi-stage compressor. While FIG. 1 includes a single compressor, the system 100 could include multiple compressors connected in parallel. A single-stage compressor is generally configured to operate at a constant speed to increase the pressure of the working fluid to keep the working fluid moving along the working-fluid conduit subsystem 104. Meanwhile, a multi-stage compressor may include multiple compressors configured to operate at a constant speed to increase the pressure of the working fluid to keep the working fluid moving along the working-fluid conduit subsystem 104. In this configuration, one or more compressors can be turned on or off to adjust characteristics of heat transfer at the condenser 106 and/or evaporator 110. In some embodiments, the compressor 102 may be configured to operate at multiple speeds or as a variable speed compressor. For example, the compressor 102 may be configured to operate at different predetermined speeds. The compressor 102 is in signal communication with the controller 140 using a wired or wireless connection. The controller 140 is configured to provide commands or signals to control the operation of the compressor 102.

The working fluid conduit subsystem 104 facilitates the movement of the working fluid (e.g., a refrigerant) through the expansion compression cycle facilitated by the compressor 102, condenser 106, expansion device 108, and evaporator 110. The working fluid may be any acceptable working fluid including, but not limited to, fluorocarbons (e.g. chlorofluorocarbons), ammonia, non-halogenated hydrocarbons (e.g. propane), hydroflurocarbons (e.g. R-410A, R32), or any other suitable type of refrigerant.

The condenser 106 is generally any heat exchanger, such as a water condenser, located downstream of the compressor 102 and is used to remove heat from the working fluid (e.g., via heat transfer with coolant from conduit 114*c*). The compressed, cooled working fluid flows from the condenser 106 toward the expansion device 108.

The expansion device 108 is configured to reduce pressure from the working fluid. The expansion device 108 is coupled to the working-fluid conduit subsystem 104 downstream of the condenser 106. In this way, the working fluid is delivered to the evaporator 110 and receives heat from coolant from conduit 114*d* to produce a cooled coolant flow in conduit 114*b*, which may be provided for cooling of an indoor space, such as a room or building or an industrial process. In general, the expansion device 108 may be a valve such as an expansion valve or a flow control valve or any other suitable valve for reducing pressure from the working fluid while, optionally, providing control of the rate of flow of the working fluid. In some cases, the expansion device 108 may be mechanically controlled with an internal regulation system, such that there may be no communication with the controller 140. In other cases, the expansion device 108 may be in communication with the controller 140 (e.g., via wired and/or wireless communication) to receive control signals for opening and/or closing associated valves and/or providing flow measurement signals corresponding to the rate of working fluid flow through the conduit subsystem 104.

The evaporator 110 is generally any heat exchanger configured to provide heat transfer between working fluid flowing through the evaporator 110 and coolant from conduit 114*d*. The evaporator 110 is fluidically connected to the compressor 102, such that working fluid generally flows from the evaporator 110 to the compressor 102.

The coolant pump 112 is generally any fluid pump configured to provide a flow of coolant, such as water. The coolant pump 112 and coolant conduit subsystem 114*a-f* facilitates the flow of coolant through the system 100 as illustrated in FIG. 1 and described herein. Each of the outdoor coils 116*a-e* is a heat exchanger (e.g., comprising one or more tubes and/or coils) configured to transfer heat from a coolant flowing therethrough to outdoor air, thereby cooling the coolant. The outdoor coils 116*a-e* are arranged in parallel, such that a first-side inlet/outlet of each coils 116*a-e* is in fluid communication with first-side coolant conduits 114*e,f* and a second-side inlet/outlet of each coils 116*a-e* is in fluid communication with the second-side coolant conduits 114*g,h*. The system 100 may include a fan 118*a-e* for each or several coils 116*a-e*. The fans 118*a-e* may be any type of fan or air moving device operable to provide a flow of outdoor air over the coils 116*a-e*.

Figure 5:
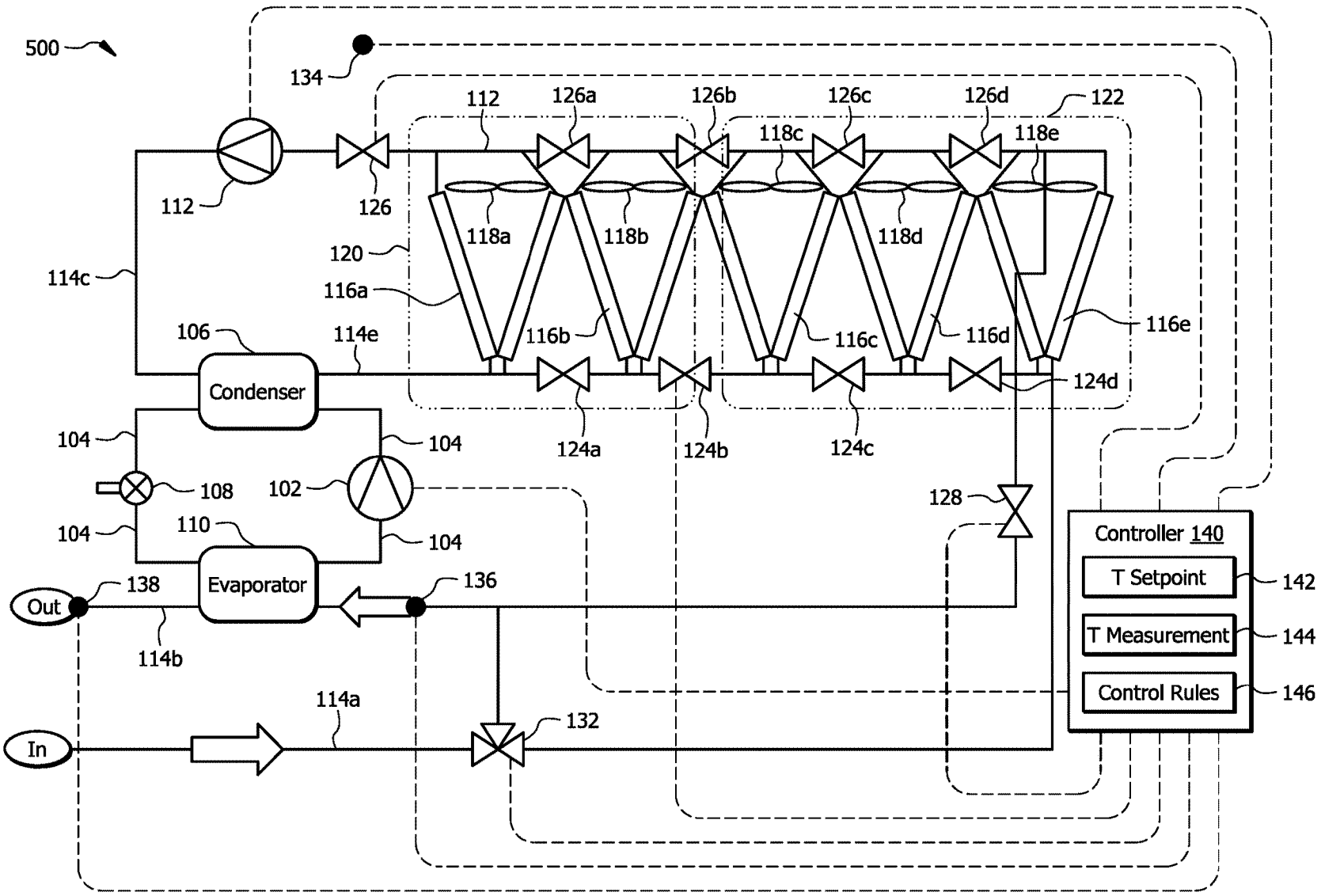
FIG. 5 is a diagram of an example embodiment of combined chiller/free cooling system that is operable in different split chiller/free cooling configurations.

A first valve 124 is located between first-side coolant conduits 114*e* and 114*f*, and a second valve 126 is located between second-side coolant conduits 114*g* and 114*h*, as illustrated in FIG. 1, thereby separating the coils 116*a-e* into a first set 120 of coils 116*a,b* on one side of the first valve 124 and second valve 126 and a second set 122 of coils 116*c-e* on the other side of the first valve 124 and second valve 126. While the first valve 124 and second valve 126 are shown between coils 116*b* and 116*c*, it should be understood that the first valve 124 and second valve 126*a* may be located in between any pair of adjacent coils 116*a-e*. Moreover, while the example of FIG. 1 shows multiple coils 116*a-d* in each coil set 120, 122, one or both of the first coil set 120 and the second coil set 122 may include a single coil 116*a-d*. The number of coils 116*a-d* in each set may be selected based on cooling needs, average ambient temperature, and the like. In some embodiments, the system 100 includes multiple first and second valves 124, 126 between multiple pairs of adjacent coils 116*a-e*, for example, as illustrated in FIG. 5 and described in greater detail below.

A third valve 128 is positioned to regulate the flow of coolant from the second-side coolant conduit 114*h* toward the evaporator 110, as illustrated in FIG. 1. A fourth valve 130 is positioned to regulate the flow of coolant from the second-side coolant conduit 114*g* toward the condenser 106. A three-way valve 132 is in fluid communication with coolant conduit 114*a*, 114*f*, and coolant conduit 114*d* as illustrated in FIG. 1. The various valves 124, 126, 128, 130, and 132 are generally operated (e.g., opened and/or closed) by the controller 140 in order to achieve a desired coolant flow to facilitate cooling of the coolant using refrigerant-based cooling (see high temperature mode configuration of FIG. 2), cooling of the coolant using free cooling (see low temperature configuration of FIG. 3), cooling of the coolant using a combination of refrigerant-based cooling and free cooling (see intermediate temperature configurations of FIGS. 4 and 5). In some embodiments, the system 100 may be further coupled to a heat recovery unit, which may further facilitate cooling of the coolant flowing through the conduit subsystem 114*a-f* (see examples of FIGS. 6 and 7).

The system 100 may include one or more sensors 134, 136, 138 in signal communication with the controller 140. Sensors 134 may be any suitable type of sensor for measuring outdoor air temperature and/or other properties of the outdoor environment. Sensors 136 and 138 may be positioned and configured to measure a temperature of coolant provided to evaporator 110 and a temperature of coolant output from the evaporator 110, respectively, as illustrated in FIG. 1. Information from the sensors 134, 136, 138 may be provided to the controller 140 as temperature measurements 144. Temperature measurements 144 may include an outdoor temperature, a temperature of coolant at the evaporator 110 inlet, and/or a temperature of coolant at the evaporator 110 outlet. In some embodiments, outdoor temperature may also or alternatively be determined based on weather information (e.g., a weather forecast provided to the controller 140).

The controller 140 generally receives information from sensors 134, 136, and/or 138 and uses this information to operate the system 100 according to predefined control rules 146. The control rules 146 include any instructions, logic, and/or code for adjusting operation of the compressor 106, coolant pump 112, expansion valve 108, and/or valves 124, 126, 128, 130, 132 based at least in part on a measured temperature 144. For example, operation of the valves 124, 126, 128, 130, 132 may be determined based on comparison of a measured temperature 144 of outdoor air (e.g., from sensor 134) to a temperature setpoint 142. The temperature setpoint 142 may be a target temperature for cooling an indoor space using the cooled coolant provided via conduit 114*b*. The controller 140 is described in greater detail below with respect to FIG. 12.

Figure 6:
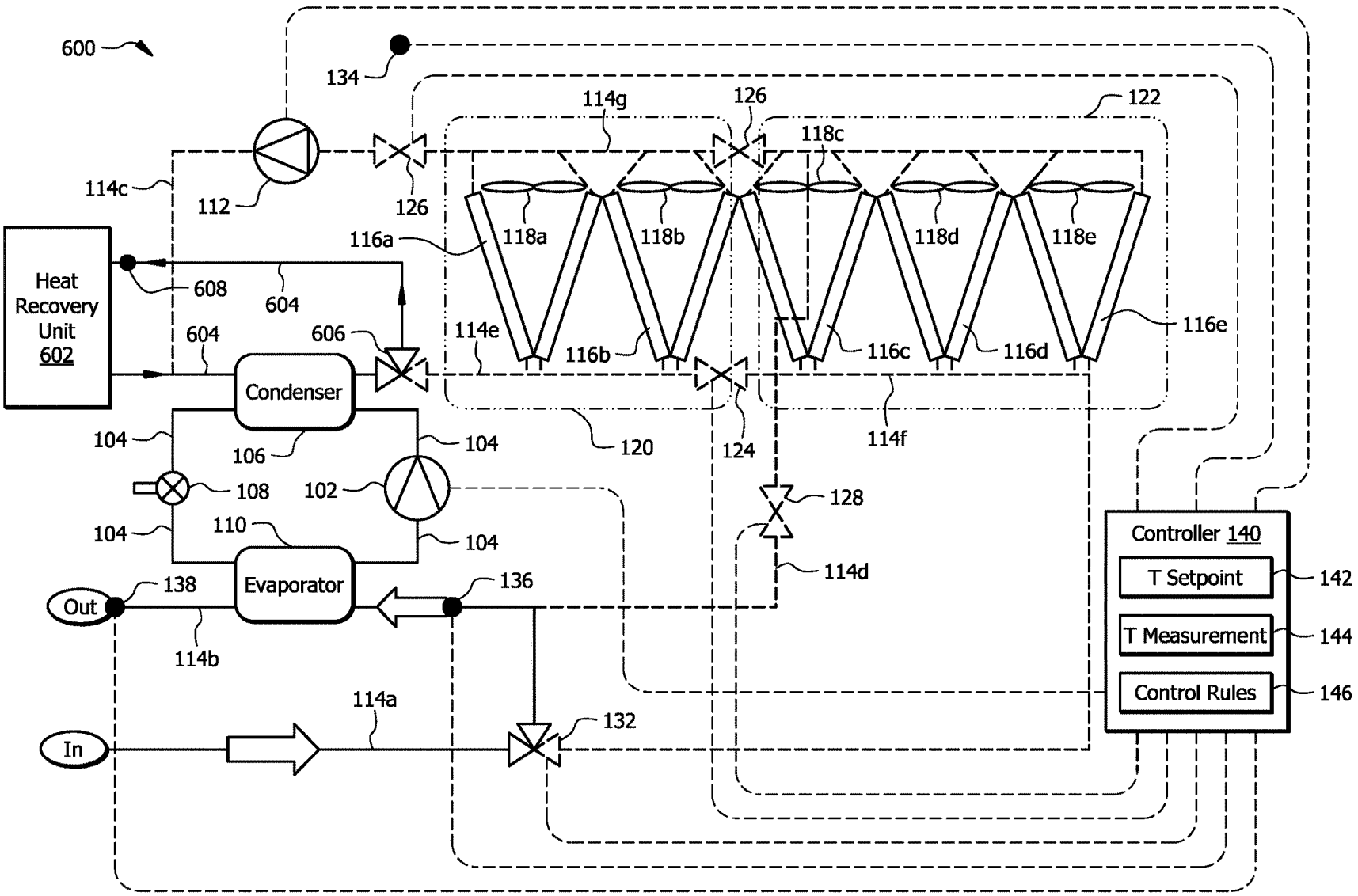
FIG. 6 is a diagram of an example embodiment of a combined chiller/free cooling system coupled to a heat recovery unit.
Figure 7:
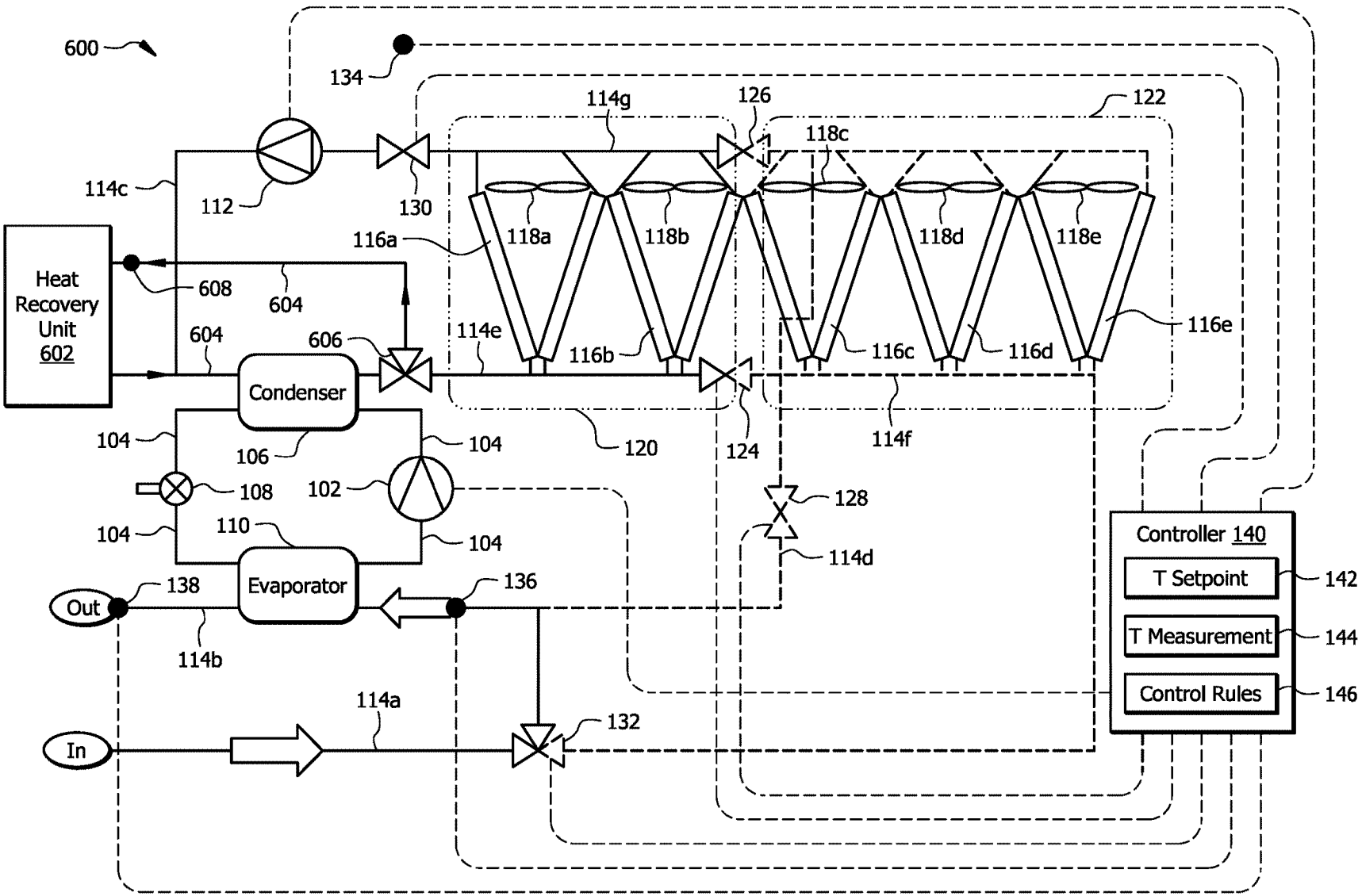
FIG. 7 is a diagram of the example combined chiller/free cooling system of FIG. 6 in an alternative configuration.

For example, if a measured temperature 144 of outdoor air is greater than a threshold amount above the temperature setpoint 142, the controller 140 may use control rules 146 for operating in a high temperature mode by closing valve 128 and adjusting the three-way valve 132 to allow coolant flow from input line 114*a* to conduit 114*d* and prevent flow from conduit 114*a* to conduit 114*f* (see FIG. 2 and corresponding description below). If a measured temperature 144 of outdoor air is greater than a threshold amount below the temperature setpoint 142, the controller 140 may use control rules 146 for operating in a low temperature mode by closing valve 130 and adjusting the three-way valve 132 to allow flow of coolant from conduit 114*a* to conduit 114*f* and prevent flow of coolant from conduit 114*a* to conduit 114*d* (see FIG. 3 and corresponding description below). If a measured temperature 144 of outdoor air is not greater than a threshold amount above or below the temperature setpoint 142, the controller 140 may use control rules 146 for operating in an intermediate temperature mode by closing valves 124 and 126 and adjusting the three-way valve 132 to allow flow of coolant from conduit 114*a* to conduit 114*f* and prevent flow of coolant from conduit 114*a* to conduit 114*d* (see FIGS. 4 and 5 and corresponding description below). In embodiments, that include a heat recovery unit, the control rules 146 include instructions for adjusting valves 124, 126, 128, 130, 132, such that coolant may be cooled using fluid received from the heat recovery unit alone or in combination with the refrigerant-based cooling and/or free cooling, as illustrated in FIGS. 6 and 7.

Connections between various components of the system 100 may be wired and/or wireless. For example, conventional cable and contacts may be used to couple the controller 140 to the various components of the system 100, including the compressor 102, coolant pump 112, expansion valve 108, and valves 124, 126, 128, 130, 132, and sensors 134, 136, 138. In some embodiments, a wireless connection is employed to provide at least some of the connections between components of the system 100 such as, for example, a connection between controller 140 and the sensors 134, 136, 138 of system 100. In some embodiments, a data bus couples various components of the system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 140 to other components of the system 100.

Example High Temperature Mode Operation

Figure 2:
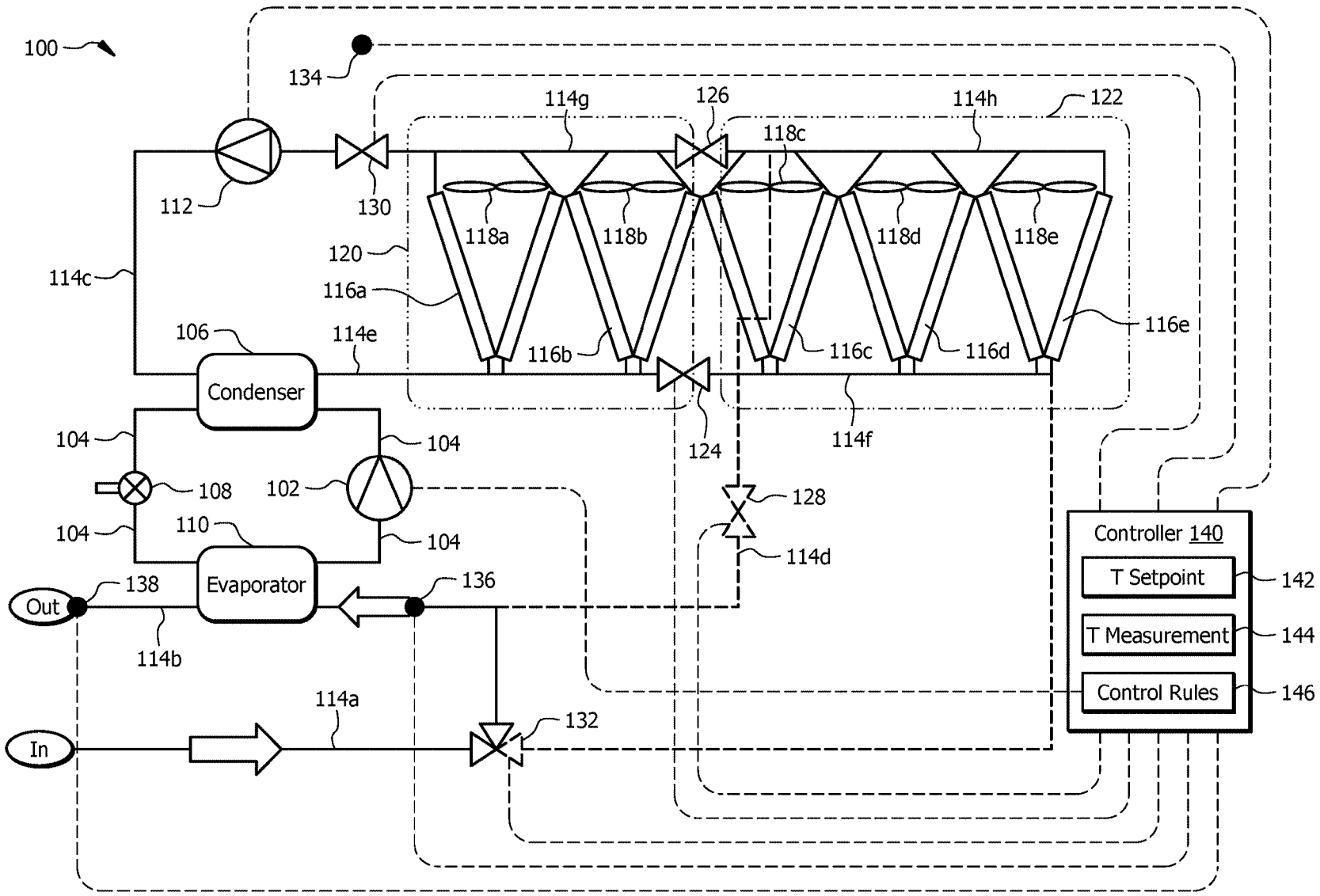
FIG. 2 is a diagram of an example combined chiller/free cooling system of FIG. 1 operating in a high temperature mode.

FIG. 2 illustrates an example operation of system 100 in a high ambient temperature mode. In this example operation, the controller 140 may receive an outdoor temperature measurement 144 (e.g., from sensor 134 and/or weather information) and an indoor setpoint temperature 142 (e.g., from an indoor system that receives cooled coolant from conduit 114*b*). Based on a comparison of the outdoor temperature measurement 144 to the indoor setpoint temperature 142, the controller 140 determines that the system 100 should operate in a high temperature mode. For example, the controller 140 may determine a difference between the outdoor air temperature 144 ($T_{outdoor}$) and the setpoint temperature 142 ($T_{setpoint}$) and determine whether the difference ($T_{outdoor}-T_{setpoint}$) is greater than a predefined threshold value (e.g., a threshold value 1214 of FIG. 12). In some cases, the controller 140 may receive a temperature measurement 144 of coolant (e.g. entering evaporator 110 from sensor 136 and/or exiting evaporator 110 from sensor 138), and the coolant temperature 144 may be compared to the temperature setpoint 142, similarly to as described above, to determine that the system 100 should operate in the high temperature mode. Further examples of determining the operating mode of the system 100 are described with respect to step 804 of FIG. 8 below.

After determining that the system 100 should operate in the high temperature operating mode, the controller 140 adjusts the valves 124, 126, 128, 130, and 132 as illustrated in FIG. 2. In FIG. 2, closed lines correspond to open valves, and dashed lines correspond to closed valves. Similarly, closed lines in conduits 104 and 114*a-f* correspond to conduits 104, 114*a-f* in which there is a flow of fluid (i.e., working fluid or coolant) and dashed lines correspond to conduits 104, 114*a-f* without flow of fluid. In the high temperature operating mode, the controller 140 may cause the coolant pump 112 to operate to provide a flow of coolant through conduits 114*c,e,f,h,g* and the coils 116*a-e*. The controller 140 causes the first valve 124 to be in an open position such that flow of coolant is allowed between coolant conduit 114*e* and 114*f*. The controller 140 also causes the second valve 126 to be in the open position such that flow of coolant is allowed between coolant conduit 114*g* and coolant conduit 114*h*. The controller 140 causes the third valve 128 to be in a closed position such that flow of coolant is prevented between coolant conduit 114*h* and coolant conduit 114*d*. The controller 140 causes the fourth valve 130 to be in an open position such that flow of coolant is allowed between coolant conduit 114*g* and the condenser 106. The controller 140 causes the three-way valve 132 to be in a position such that flow of coolant is allowed between coolant input conduit 114*a* and coolant conduit 114*d* and prevented between the input conduit 114*a* and coolant conduit 114*f*.

In the high temperature mode configuration of FIG. 2, all of the coils 116*a-e* are used for refrigerant-based cooling. As such, the controller 140 may also provide a control signal to the compressor 102 to cause the compressor 102 to operate. Accordingly, in the high temperature operating mode, the condenser 106 receives coolant cooled by the coils 116*a-e* and transfers heat from the working fluid to the cooled coolant, thereby cooling the working fluid. The evaporator 110 receives working fluid cooled by the condenser 106 and transfers heat from the flow of the coolant received from input conduit 114*a* and passed to the evaporator 110 via three-way valve 132 to the cooled working fluid, thereby cooling the coolant before it is returned to the indoor system via conduit 114*b*.

Example Low Temperature Mode Operation

Figure 3:
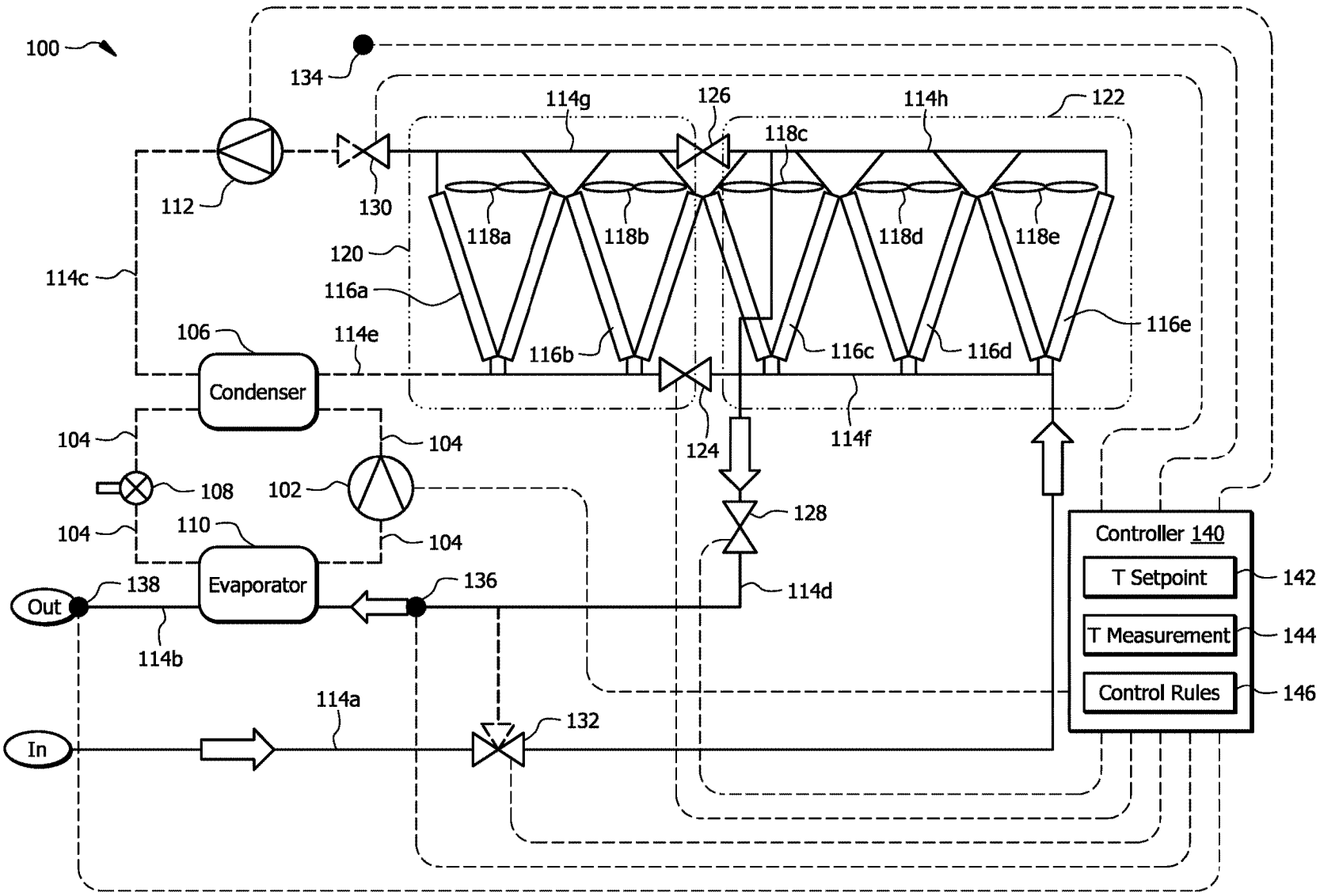
FIG. 3 is a diagram of an example combined chiller/free cooling system of FIG. 1 operating in a low temperature mode.

FIG. 3 illustrates an example operation of system 100 in a low ambient temperature mode. In this example operation, the controller 140 receive an outdoor temperature measurement 144 (e.g., from sensor 134 and/or weather information) and an indoor setpoint temperature 142 (e.g., from an indoor system that receives cooled coolant from conduit 114*b*). Based on a comparison of the outdoor temperature measurement 144 to the indoor setpoint temperature 142, the controller 140 determines that the system 100 should operate in a low temperature mode. For example, the controller 140 may determine a difference between the setpoint temperature 142 ($T_{setpoint}$) and the outdoor air temperature 144 ($T_{outdoor}$) and determine whether the difference ($T_{setpoint}-T_{outdoor}$) is greater than a predefined threshold value (e.g., a threshold value 1214 of FIG. 12). As another example, the controller 140 may receive a temperature measurement 144 of coolant (e.g. entering evaporator 110 from sensor 136 and/or exiting evaporator 110 from sensor 138) and use this coolant temperature 144 to determine the operating mode of the system 100. For instance, the controller 140 may determine that the system 100 should operate in the low temperature operating mode by determining that the coolant temperature 144 is less than a threshold value (e.g., a threshold value 1214 of FIG. 12). Further examples of determining the operating mode of the system 100 are described with respect to step 804 of FIG. 8 below.

After determining that the system 100 should operate in the low temperature operating mode, the controller 140 adjusts the valves 124, 126, 128, 130, and 132 as illustrated in FIG. 3. In FIG. 3, closed lines correspond to open valves, and dashed lines correspond to closed valves. Similarly, closed lines in conduits 104 and 114*a-f* correspond to conduits 104, 114*a-f* in which there is a flow of fluid (i.e., working fluid or coolant) and dashed lines correspond to conduits 104, 114*a-f* without flow of fluid. The controller 140 causes the first valve 124 to be in an open position such that flow of coolant is allowed between coolant conduit 114*e* and coolant conduit 114*f*. The controller 140 also causes the second valve 126 to be in the open position such that flow of coolant is allowed between coolant conduit 114*g* and coolant conduit 114*h*. The controller 140 causes the third valve 128 to be in an open position such that flow of coolant is allowed between coolant conduit 114*h* and coolant conduit 114*d*. The controller 140 causes the fourth valve 130 to be in a closed position such that flow of coolant is prevented between coolant conduit 114*g* and the condenser 106. The controller 140 causes the three-way valve 132 to be in a position such that flow of coolant is prevented between the coolant input conduit 114*a* and coolant conduit 114*d* and allowed between the input conduit 114*a* and coolant conduit 114*f*. As such, coolant does not transfer heat with the condenser 106, and cooling of the coolant is provided through heat transfer with outdoor air at coils 116*a-e*.

In the low temperature mode configuration of FIG. 3, all of the coils 116*a-e* are used for free cooling (i.e., cooling involving heat transfer with outdoor air). As such, the controller 140 may also provide a control signal to the compressor 102 to cause the compressor 102 to turn off In some embodiments, the controller 140 may also or alternatively provide a control signal instructing coolant pump 112 to turn off. Accordingly, in the low temperature operating mode, energy consumption is decreased by not operating compressor 102 and/or coolant pump 112. The working fluid that is cooled via heat transfer with cool outdoor air at coils 116*a-e* is returned to the indoor cooling system via conduit 114*b*.

Example Intermediate Temperature Mode Operation

Figure 4:
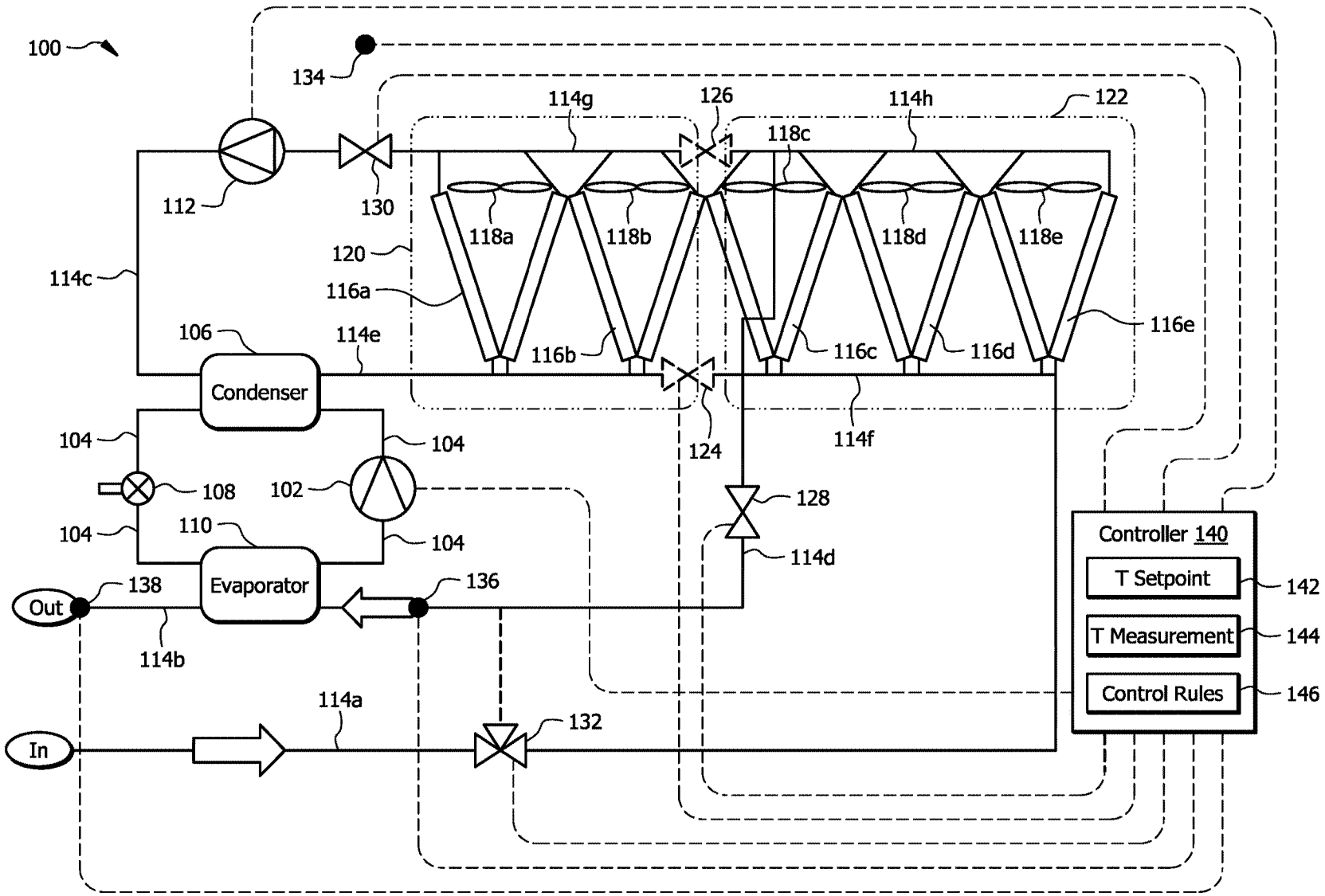
FIG. 4 is a diagram of an example combined chiller/free cooling system of FIG. 1 operating in an intermediate temperature configuration.

FIG. 4 illustrates an example operation of system 100 in an intermediate ambient temperature mode. In this example operation, the controller 140 receives an outdoor temperature measurement 144 (e.g., from sensor 134 and/or weather information) and an indoor setpoint temperature 142 (e.g., from an indoor system that receives cooled coolant from conduit 114*b*). Based on a comparison of the outdoor temperature measurement 144 to the indoor setpoint temperature 142, the controller 140 determines that the system 100 should operate in an intermediate temperature mode. For example, the controller 140 may determine that the measured temperature 144 of outdoor air is not greater than a threshold amount (e.g., a threshold value 1214 of FIG. 12) above or a threshold amount below the temperature setpoint 142. In such cases, the controller 140 may determine to operate the system 100 in the intermediate temperature mode. Further examples of determining the operating mode of the system 100 are described with respect to step 804 of FIG. 8 below.

After determining that the system 100 should operate in the intermediate temperature operating mode, the controller 140 adjusts the valves 124, 126, 128, 130, and 132 as illustrated in FIG. 4. In FIG. 4, closed lines correspond to open valves, and dashed lines correspond to closed valves. Similarly, closed lines in conduits 104 and 114*a-f* correspond to conduits 104, 114*a-f* in which there is a flow of fluid (i.e., working fluid or coolant) and dashed lines correspond to conduits 104, 114*a-f* without flow of fluid. The controller 140 causes the first valve 124 to be in a closed position such that flow of coolant is prevented between coolant conduit 114*e* and coolant conduit 114*f*. The controller 140 also causes the second valve 126 to be in a closed position such that flow of coolant is prevented between coolant conduit 114*g* and coolant conduit 114*h*. Closing the first valve 124 and the second valve 126 segregates coils 116*a,b* into the first coil set 120 and coils 116*c-e* into the second coil set 122. The first coil set 120 is used for refrigerant-based cooling (i.e., using heat transfer with condenser 106), while the coil set 122 is used for free cooling (e.g., using heat transfer with cool outdoor air). In some embodiments, the system 100 may include additional first valves 124 and second valves 126 positioned between different adjacent pairs of coils 116*a-e*, such that the controller 140 may select the number of coils 116*a-e* to include in the first coil set 120 for refrigerant-based cooling and in the coil set 122 for free cooling (see FIG. 5 and corresponding description below).

Still referring to the intermediate temperature operating mode of FIG. 4, the controller 140 also causes the third valve 128 to be in an open position such that flow of coolant is allowed between coolant conduit 114*h* and coolant conduit 114*d*. The controller 140 causes the fourth valve 130 to be in an open position such that flow of coolant is allowed between coolant conduit 114*g* and the condenser 106. The controller 140 causes the three-way valve 132 to be in a position such that flow of coolant is prevented between the coolant input conduit 114*a* and coolant conduit 114*d* and allowed between the input conduit 114*a* and coolant conduit 114*f*.

In the intermediate temperature mode configuration of FIG. 4, the first coil set 120 is used for refrigerant-based cooling (i.e., using heat transfer with condenser 106), while the coil set 122 is used for free cooling (e.g., using heat transfer with at least moderately cool outdoor air). As such, coolant from coil set 120 transfers heat with the condenser 106 in order to facilitate cooling using evaporator 110. Meanwhile, coolant is also cooled via free cooling using coil set 122 via heat transfer with outdoor air. Accordingly, less energy may be consumed to operate coolant pump 112 and/or compressor 102, since at least a portion of cooling is achieved using free cooling.

FIG. 5 illustrates an example system 500 that is alternative embodiment of the system 100 in which the number of coils 116*a-e* used for refrigerant-based cooling and free cooling can be intelligently adjusted. The system 500 includes the same components of system and a plurality of first valves 124*a-d* and second valves 126*a-d*. The multiple valves allow the system 100 to operate in various "split" intermediate temperature configurations such that a different number of the coils 116*a-e* can be used for refrigerant-based cooling (i.e., coils 116*a-e* to left of whichever valves 124*a-d*, 126*a-d* are closed) while the remaining coils 116*a-e* are used for free cooling (i.e., the coils 116*a-e* to the right of whichever valves 124*a-d*, 126*a-d* are closed). As an example, when the controller 140 determines that the system 500 should operate in the intermediate temperature operating mode (e.g., as described above and below with respect to FIG. 8), the controller 140 of system 500 may further determine which one of the first valves 124*a-d* and which one of the second valves 126*a-d* to close. For instance, if the outdoor temperature 144 is not greater than a threshold amount above or below the temperature setpoint 142 but the outdoor temperature 144 is relatively cold, more of the coils 116*a-e* may be used for free cooling.

Figure 12:
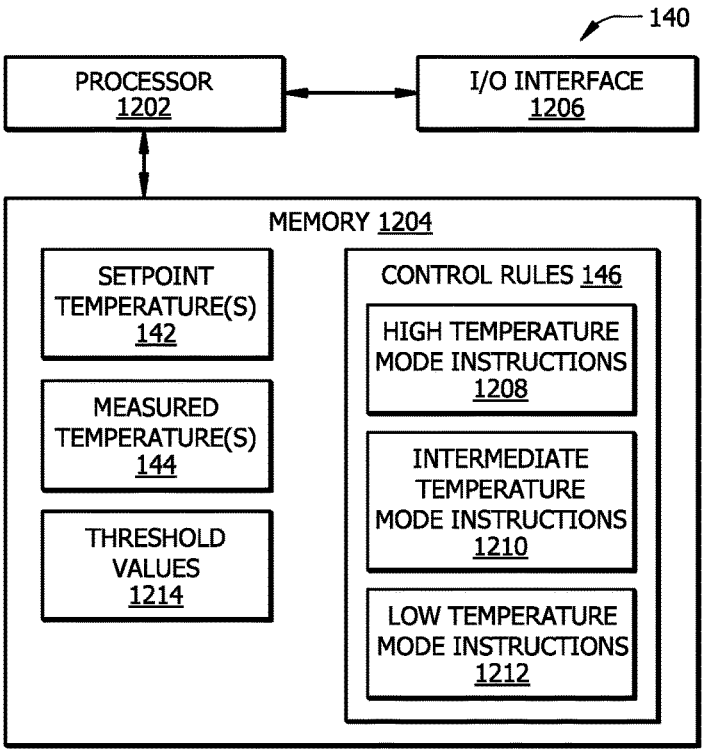
FIG. 12 is a diagram of an example controller of the chiller/free cooling system of any of FIGS. 1-7.

As an illustrative example, the controller 140 may determine which valves 124*a-d* and 126*a-d* to close based on a comparison of the outdoor temperature 144 and/or the setpoint temperature 142 to a predefined temperature associated with effective free cooling operation (e.g., a threshold temperature 1214 of FIG. 12). If the outdoor temperature 144 is nearer the predefined temperature, then more of the coils 116*a-e* may be used for free cooling. As an example, if the outdoor temperature 144 is within a first threshold range above the predefined temperature, the controller 140 may close valves 124*a* and 126*a*, such that coils 116*b-e* are used for free cooling. As another example, if the outdoor temperature 144 is within a second threshold range (that is greater than the first threshold range) above the predefined temperature, the controller 140 may close valves 124*b* and 126*b*, such that coils 116*c-e* are used for free cooling. As yet another example, if the outdoor temperature 144 is within a third threshold range (that is greater than the second threshold range) above the predefined temperature, the controller 140 may close valves 124*c* and 126*c*, such that coils 116*d,e* are used for free cooling. As yet another example, if the outdoor temperature 144 is within a fourth threshold range (that is greater than the third threshold range) above the predefined temperature, the controller 140 may close valves 124*d* and 126*d*, such that only coil 116*e* is used for free cooling. Valves 128, 130, and 132 are positioned/configured as described with respect to FIG. 4 above.

Example Operation with a Heat Recovery Unit

FIG. 6 illustrates an example system 600 that is an alternative embodiment of the system 100 (or system 500) in which the system 600 is coupled to a heat recovery unit 602. The heat recovery unit 602 may be any system configured to recover heat to provide heating indoors (e.g., to a portion of an indoor space). The heat recovery unit 602 generally outputs a flow of cooled coolant and receives a higher temperature coolant following heat transfer at condenser 106. The system 600 includes the same components of system 100 (or system 500) along with the heat recovery unit 602, additional fluid conduit 604, an additional three-way valve 606, and a temperature sensor 608 configured to measure the temperature of the heated coolant supplied to the heat recovery unit 206. Measurements from the temperature sensor 608 are provided to the controller 140 as temperature measurements 144. The controller 140 is generally configured to use control rules 146 to operate the three-way valve 606 to allow receipt of coolant (e.g., water or any other appropriate coolant) from the heat recovery unit 602 at condenser 106, cooling of working fluid by the received coolant, and return of the resulting heated coolant back to the heat recovery unit 602. In some embodiments (e.g., for cases in which coolant from the heat recovery unit 602 and the system 100 should not be allowed to mix), a heat exchanger may be placed at the position of valve 606. Coolant from the recovery unit 602 may transfer heat with the heated coolant output by condenser 106 and provided as heated coolant back to the heat recovery unit 602.

The controller 140 may use measured temperatures 144 and/or the setpoint 142 to determine whether the cooling of working fluid in conduit subsystem 104 and of coolant provided to the indoor system via coolant conduit 114*b* should be provided through heat exchange with the heat recovery unit 602 alone (see configuration of FIG. 6) or in combination with refrigerant-based cooling and/or free cooling (see configuration of FIG. 7). For example, if the controller 140 determines that there is a request for heat recovery (e.g., at a requested coolant temperature) from the heat recovery unit 602 and that the temperature 144 of coolant provided to the heat recover unit 602 is less than or equal to a threshold value (e.g., a threshold value 1214 of FIG. 12 corresponding to the requested coolant temperature value), the controller 140 may determine that cooling from the heat recovery unit 602 alone is appropriate.

In this example scenario, the controller 140 causes the valves 124, 126, 128, and 130 to be in closed position such that flow of coolant is prevented through these valves 124, 126, 128, 130, as illustrated in FIG. 6. The controller 140 causes the three-way valve 132 to be in a position such that flow of coolant is allowed between coolant input conduit 114*a* and coolant conduit 114*d* and prevented between input conduit 114*a* and coolant conduit 114*f*. The controller 140 also causes the added three-way valve 606 to be in a position such that fluid flow is allowed between inlet conduit 604 and outlet conduit 604 (returning to the heat recovery unit 602) but prevented between inlet conduit 604 and coolant conduit 114*e*. The controller 140 may turn on the compressor 102 and turn off coolant pump 112. During operation in the configuration of FIG. 6, power consumption may be reduced because coolant pump 112 may not be operating (i.e., may be turned off). Additionally, the heat recovered by the heat recovery unit 602 may provide further energy savings (e.g., because an active power source, such as a resistive heater or gas heater, is not needed or is needed to a lesser extent).

As another example, if the controller 140 determines that there is a request for heat recovery from the heat recovery unit 602 (e.g., at a requested coolant temperature) and that the temperature of coolant provided to the heat recovery unit 602 is greater than the threshold value but less than a second threshold associated with being too hot to use the heat recovery unit 602, the controller 140 may determine that some of the heated coolant should be directed through coolant conduit 114*e* to prevent overheating of the heat recovery unit 602. FIG. 7 illustrates a possible configuration for this example scenario in which the coil set 120 are used to provide supplemental cooling. As shown in FIG. 7, the controller 140 causes the first valve 124 to be in a closed position such that flow of coolant is prevented between coolant conduit 114*e* and coolant conduit 114*f*. The controller 140 also causes the second valve 126 to be in a closed position such that flow of coolant is prevented between coolant conduit 114*g* and coolant conduit 114*h*. The controller 140 causes the third valve 128 to be in an open position such that flow of coolant is allowed between coolant conduit 114*h* and coolant conduit 114*d*. The controller causes the fourth valve 130 to be in an open position such that flow of coolant is allowed between coolant conduit 114*g* and the condenser 106. The controller 140 causes the three-way valve 132 to be in a position such that flow of coolant is allowed between the coolant input conduit 114*a* and the coolant conduit 114*d* and prevented between the input conduit 114*a* and the coolant conduit 114*f*. The controller 140 also causes the added three-way valve 606 to be in a position such that fluid flow is allowed between inlet conduit 604 and both coolant conduit 114*e* and outlet conduit 604 (returning to the heat recovery unit 602). The controller 140 may turn on the compressor 106 and coolant pump 112 to operate as illustrated in FIG. 7.

Example Methods of Operating Combined Chiller/Free Cooling Systems

Figure 8:
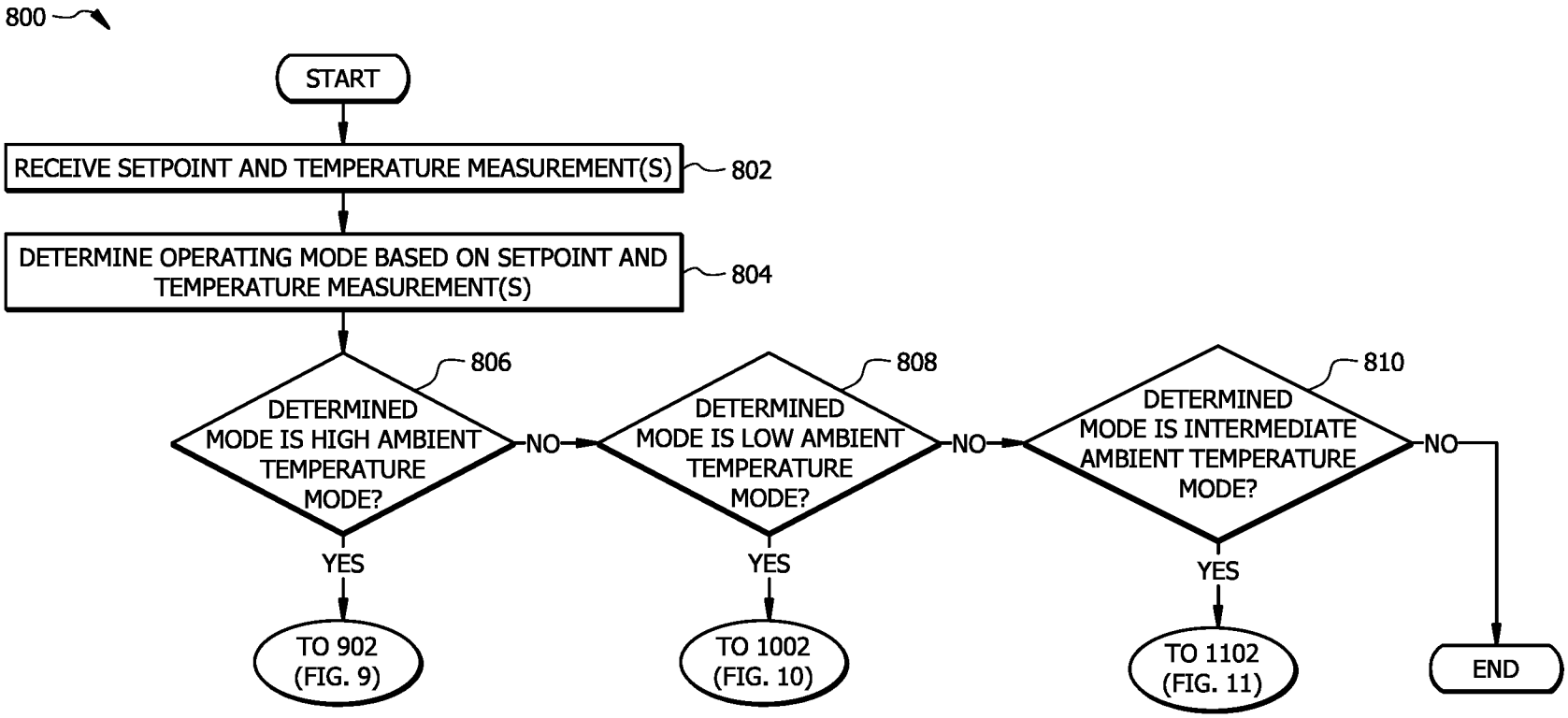
FIG. 8 is a flowchart illustrating an example method of operating the combined chiller/free cooling system of any of FIGS. 1-7 and determining an operating mode of the system.

FIG. 8 is a flowchart of an example method 800 of operating the systems 100, 500, and/or 600 described in any of FIGS. 1-7. For conciseness, example method 800 is described with respect to system 100. However, the method 800 may be performed using system 500 of FIG. 5 and system 600 of FIGS. 6 and 7. Example method 800 includes processes for determining an appropriate operating mode of the system 100 and is linked to example method 900 for operating in a high temperature mode (FIG. 9), example method 1000 for operating in a low temperature mode (FIG. 10), and example method 1100 for operating in an intermediate temperature mode (FIG. 11).

Method 800 may begin at step 802 where the controller 140 receives the setpoint temperature 142 and temperature measurements 144. The temperature setpoint 142 is generally a target temperature of an indoor space that is cooled at least in part using the cooled coolant provided via coolant conduit 114*b* of system 100. The temperature measurements 144 may include a measurement of outdoor temperature (e.g., from sensor 134 and/or available weather information) and/or measurement(s) of coolant temperature (e.g., from sensors 136, 138, 608).

At step 804, the controller 140 determines a mode in which to operate the system 100 (e.g., based on control rules 146) using the temperature setpoint 142 and the temperature measurements 144. For example, the controller 140 may compare the temperature setpoint 142 to the outdoor temperature 144. For instance, if a measured temperature 144 of outdoor air is greater than a threshold amount above the temperature setpoint 142, the controller 140 may determine that the system 100 should operate in a high temperature mode. If the measured temperature 144 of outdoor air is greater than a threshold amount below the temperature setpoint 142, the controller 140 may determine that the system should operate in the low temperature mode. If a measured temperature 144 of outdoor air is not greater than a threshold amount above or below the temperature setpoint 142, the controller 140 may determine the system 100 should operate in an intermediate temperature mode. As another example, the controller 140 may compare the temperature setpoint 142 to a coolant temperature 144 measured by sensors 136 and/or 138. For instance, If the system 100 is currently operating in high temperature mode (see FIG. 2) and the resulting coolant temperature 144 measured at sensor 138 is colder than necessary to achieve the setpoint temperature 142 (e.g., if the coolant temperature 144 is less than a threshold amount below the setpoint temperature 142), the controller 140 may determine that partial free cooling operation may be appropriate (e.g., in the intermediate temperature mode). This may improve operating efficiency (e.g., decrease energy consumption) while protecting against undesirable freezing of coolant.

Figure 9:
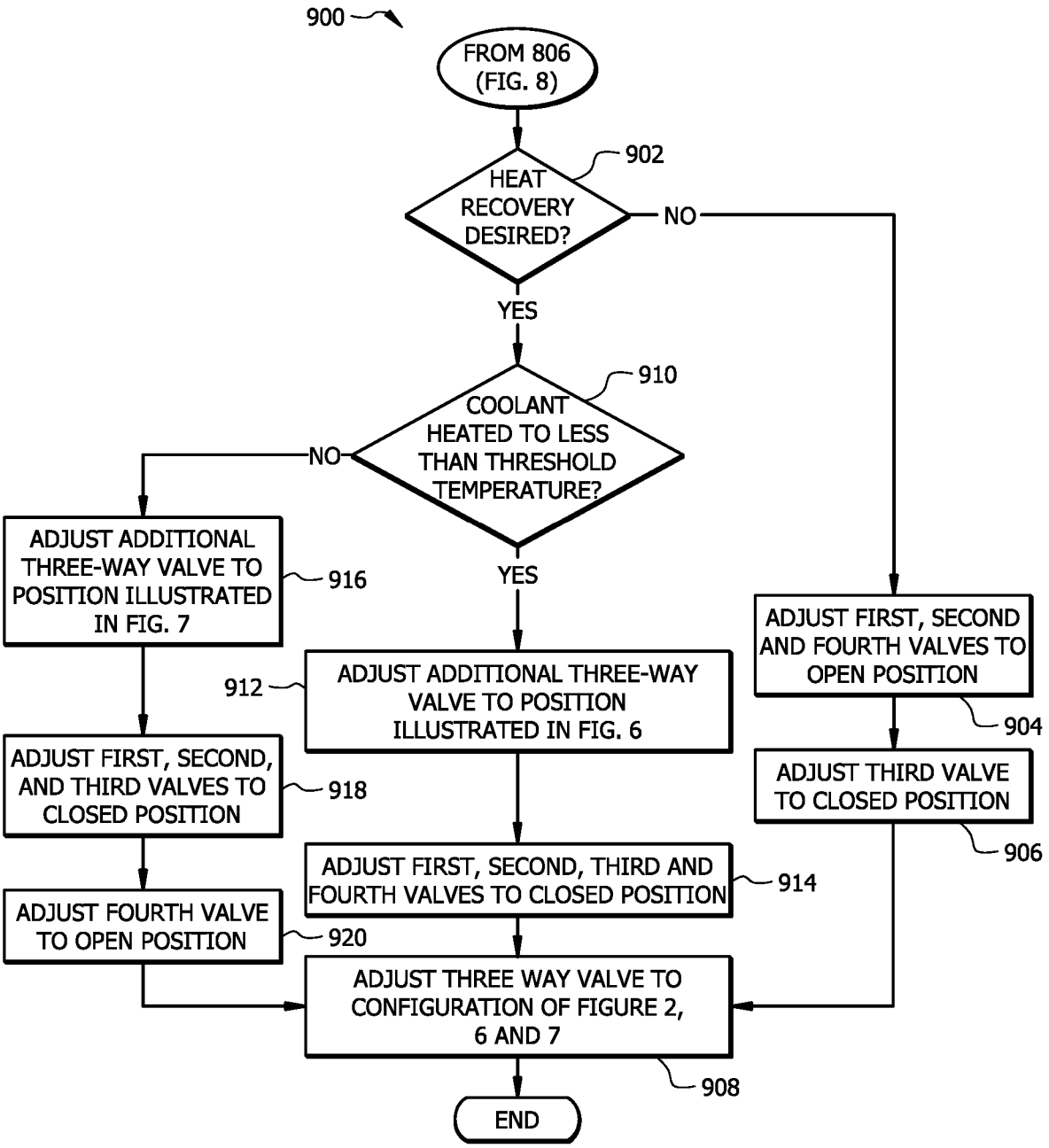
FIG. 9 is a flowchart illustrating an example method of operating the combined chiller/free cooling system of any of FIGS. 1-7 in a high temperature operating mode.

At step 806, if the controller 140 determines that the system 100 should operate in the high temperature mode, the controller 140 proceeds to step 902 of the example method 900 shown in FIG. 9. Referring now to FIG. 9, the controller 140 determines if heat recovery is desired at step 902. For example, the controller 140 may determine if a request for heat recovery is received from the heat recovery unit 602 of FIG. 6. Heat recovery may be requested, for example, if heating is desired for at least a portion of an indoor space.

If heat recovery is not requested at step 902, the controller 140 proceeds to steps 904, 906, and 908 to configure the system 100 as illustrated in FIG. 2 and described above. At step 904, the controller 140 causes the first valve 124, second valve 126, and fourth valve 130 to be adjusted to an open position. At step 906, the controller 140 causes the third valve 128 to be adjusted to a closed position. At step 908, the controller 140 adjusts the three-way valve 132 to the configuration illustrated in FIG. 2, such that flow of coolant is allowed between coolant input conduit 114*a* and coolant conduit 114*d* and prevented between the input conduit 114*a* and the coolant conduit 114*f*.

If heat recovery is requested at step 902, the controller 140 proceeds to step 910 to determine whether coolant is heated beyond what is requested by the heat recovery unit 602. For example, the controller 140 may determine whether the temperature 144 of coolant provided to the heat recovery unit 602 (e.g., as measured by sensor 608 of FIG. 6) is less than a threshold temperature, as described above with respect to FIGS. 6 and 7. If the coolant temperature 144 is less than the threshold temperature, then additional cooling is not needed at step 910. However, if the coolant temperature is not less than the threshold temperature, then additional cooling is needed.

If coolant is not heated beyond what is requested by the heat recovery unit 602, the controller 140 may proceed to adjust configuration of the system according to FIG. 6 at steps 912, 914, and 908. At step 912, the controller 140 causes the additional valve 606 to be adjusted as illustrated in FIG. 6, such that flow is allowed between inlet conduit 604 and outlet conduit 604 (returning to the heat recovery unit 602) but prevented between inlet conduit 604 and coolant conduit 114*e*. At step 914, the controller 140 adjusts the first, second, third and fourth valves 124, 126, 128, 130 to closed positions. At step 908, the controller 140 adjusts the three-way valve 132 to the position illustrated in FIG. 6, such that flow of coolant is allowed between the coolant input conduit 114*a* and the coolant conduit 114*d* and prevented between the input conduit 114*a* and the coolant conduit 114*f*.

If coolant is heated beyond what is requested by the heat recovery unit 602 at step 910, the controller 140 may proceed to adjust configuration of the system according to FIG. 7 at steps 916, 918, 920, and 908. At step 916, the controller 140 causes the additional valve 606 to be adjusted as illustrated in FIG. 7, such that flow is allowed between inlet conduit 604 and both coolant conduit 114*e* and outlet conduit 604 (returning to the heat recovery unit 602). At step 918, the controller 140 adjusts the first, second, and third valves 124, 126, 128 to closed positions. At step 920, the controller 140 adjusts the fourth valve 130 to an open position. The controller 140 may also turn on the coolant pump 112. At step 908, the controller 140 adjusts the three-way valve 132 to the position illustrated in FIG. 7, such that flow of coolant is allowed between the coolant input conduit 114*a* and the coolant conduit 114*d* and prevented between the input conduit 114*a* and the coolant conduit 114*f*.

Figure 10:
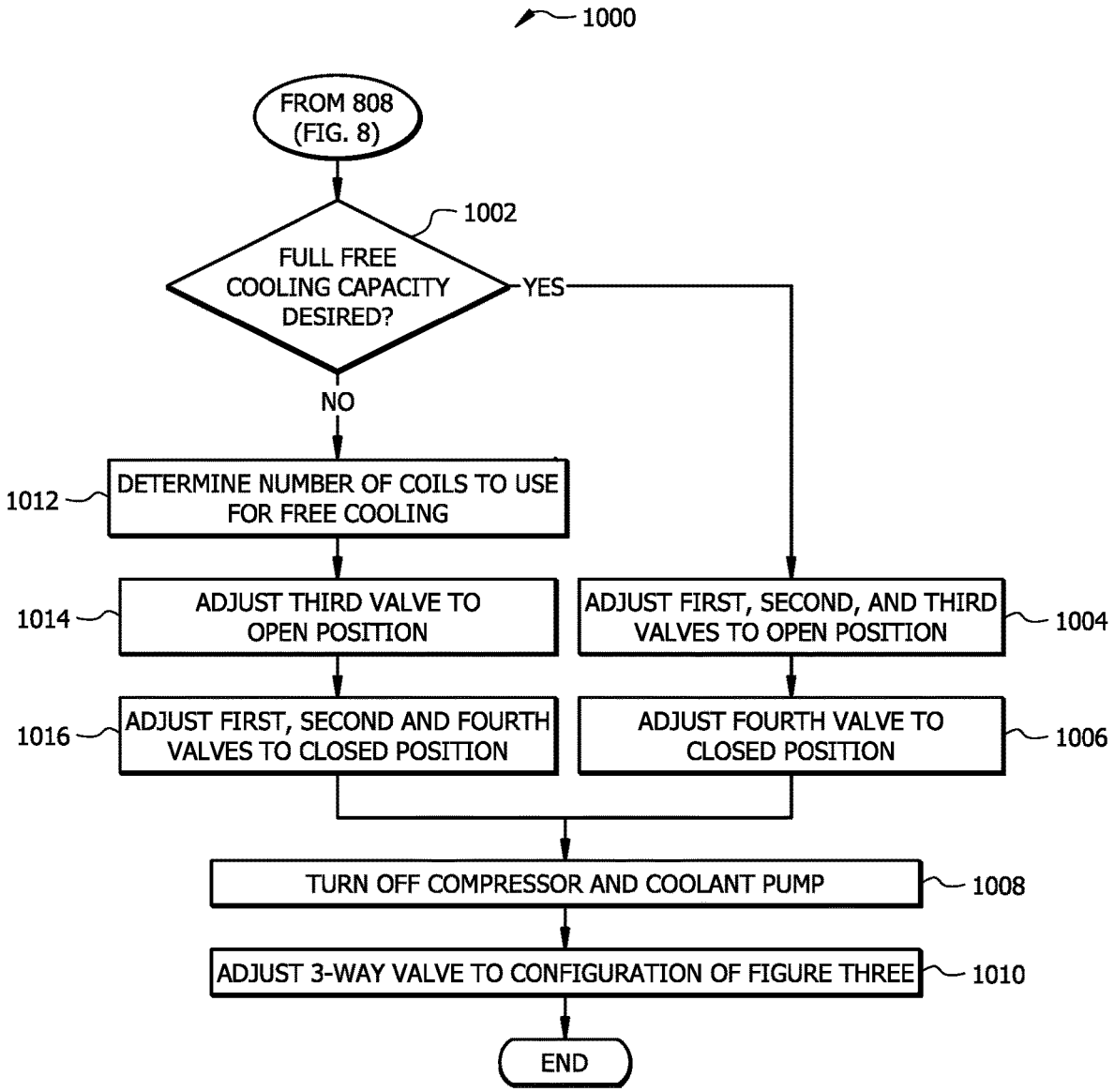
FIG. 10 is a flowchart illustrating an example method of operating the combined chiller/free cooling system of any of FIGS. 1-7 in a low temperature operating mode.
Figure 11:
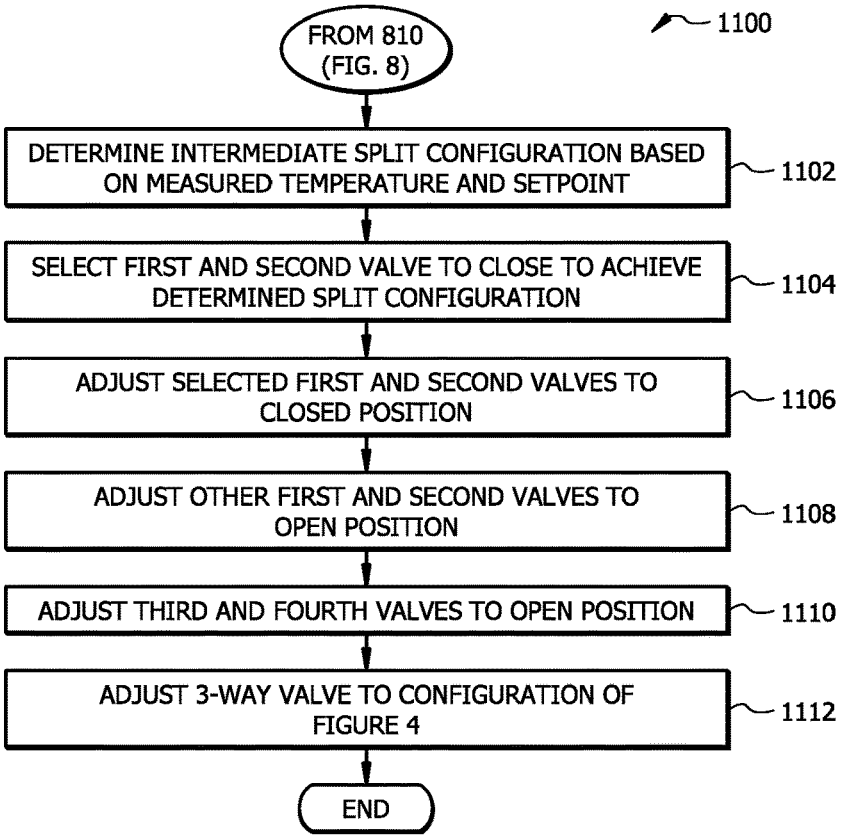
FIG. 11 is a flowchart illustrating an example method of operating the combined chiller/free cooling system of any of FIGS. 1-7 in an intermediate temperature operating mode.

Returning to FIG. 8, if the controller 140 determines at step 808 that the system 100 should operate in the low temperature mode, the controller 140 proceeds to step 1002 of the example method 1000 shown in FIG. 10. Referring now to FIG. 10, the controller 140 may determine if the full free cooling capacity of the system 100 is needed at step 1002. For example, the controller 140 may determine what coolant temperature 144 (e.g., measured by sensor 136) is achieved if all coils 116*a-e* are used for free cooling. If this temperature 144 is less than a threshold value (e.g., a value which may cause freezing in coolant conduit 114*a-f*), then the full free cooling capacity is not desired at step 1002. Otherwise, the full free cooling capacity is desired using all coils 116*a-e*.

If the full free cooling capacity is desired at step 1002, the controller proceeds to adjust the system 100 according to the configuration of FIG. 3 at steps 1004, 1006, 1008, and 1010. At step 1004, the controller 140 causes the first, second, and third valves 124, 126, 128 to be in an open position. At step 1006, the controller 140 causes the fourth valve 130 to be in a closed position. At step 1008, the controller 140 turns off the compressor 102 and the coolant pump 112 (e.g., if these components were previously turned on). At step 1010, the controller 140 adjusts the three-way valve 132 as illustrated in FIG. 3, such that flow of coolant is prevented between the coolant input conduit 114*a* and coolant conduit 114*d* and allowed between the input conduit 114*a* and coolant conduit 114*f*.

If the full free cooling capacity is desired at step 1002, the controller proceeds to step 1012 to determine a number of coils 116*a-e* to use for free cooling (e.g., for the system 500 of FIG. 5 with multiple first valves 124*a-d* and multiple second valves 16*a-d*). For example, the controller 140 may determine a number of coils 116*a-e* that will bring the coolant temperature measured by sensor 136 and/or 138 to a value that is closest to a threshold value without falling below the threshold vale. The threshold value may be a threshold 1214 of FIG. 12 selected to prevent freezing of the coolant. At step 1014, the controller 140 causes the third valve 128 to be in an open position. At step 1016, the controller 140 causes the first valve 124 (e.g., the valve 124*a-d* determined at step 1012), the second valve 126 (e.g., the valve 126*a-d* determined at step 1012), and the fourth valve 130 to be in a closed position. The controller 140 then proceeds to steps 1008 and 1010, which are described above.

Returning to FIG. 8, if the controller 140 determines at step 810 that the system 100 should operate in the intermediate temperature mode, the controller 140 proceeds to step 1102 of the example method 1100 shown in FIG. 11.

Referring now to FIG. 11, if the system 100 includes multiple first valves 124*a-d* and multiple second valves 126*a-d* as in system 500 of FIG. 5, the controller 140 may determine how to split coolant between refrigerant-based cooling in coil set 120 and free cooling in coil set 122. For example, may determine the number of coils 116*a-e* to use for refrigerant-based cooling and free cooling based on a comparison of the outdoor temperature 144 and/or the setpoint temperature 142 to a predefined temperature associated with effective free cooling operation (e.g., a threshold temperature 1214 of FIG. 12), as described in greater detail above with respect to FIG. 5.

At step 1104, the controller 140 determines which first valve 124*a-d* and which second valve 126*a-d* to close to achieve the split determined at step 1102. For example, the controller 140 determines that valves 124*b* and 126*b* are closed to achieve a split with coils 116*a,b* used for refrigerant-based cooling and coils 116*c-e* used for free cooling. For a system without multiple first valves 124*a-d* and multiple second valves 126*a-d*, such as system 100 of FIGS. 1-4, steps 1102 and 1104 may not be performed.

At step 1106, the controller 140 causes the determined first and second valves 124*a-d* and 126*a-d* to be closed, and, at step 1108, the controller 140 causes the remaining first and second valves 124*a-d* and 126*a-d* to be open. For instance, if the controller 140 determines that valves 124*b* and 126*b* should be closed at step 1104, then valves 124*b* and 126*b* are closed at step 1106, while valves 124*a,c-d* and valves 126*a,c-d* are opened at step 1108. For a system without multiple first valves 124*a-d* and multiple second valves 126*a-d*, such as system 100 of FIGS. 1-4, the controller 140 closes the first and second valves 124 and 126.

At step 1110, the controller 140 adjusts the third valve 128 and fourth valve 130 to an open position. At step 1112, the controller 140 adjusts the three-ways valve to the position illustrated in FIG. 4, such that flow of coolant is prevented between the coolant input conduit 114*a* and coolant conduit 114*d* and allowed between the input conduit 114*a* and coolant conduit 114*f*.

Modifications, additions, or omissions may be made to methods 800, 900, 1000, and 1100 depicted in FIGS. 8-11. Methods 800, 900, 1000, and 1100 may include more, fewer, or other steps. For example, steps may be performed in parallel or in any suitable order. While at times discussed as system 100 (or components thereof) performing the steps, any suitable system (e.g., system 500 of FIG. 5 or system 600 of FIGS. 6 and 7) or components of the system may perform one or more steps of the method.

Example Controller of the Combined Chiller/Free Cooling System

FIG. 12 is a schematic diagram of an embodiment of a the controller 140 of FIGS. 1-7. The controller 140 includes a processor 1202, a memory 1204, and an input/output (I/O) interface 1206.

The processor 1202 comprises one or more processors operably coupled to the memory 1204. The processor 1202 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 1204 and controls the operation of systems 100, 500, 600. The processor 1202 may be a programmable logic device, a microcontroller, a microprocessor, or any suitable combination of the preceding. The processor 1202 is communicatively coupled to and in signal communication with the memory 1204. The one or more processors are configured to process data and may be implemented in hardware or software. For example, the processor 1202 may be 8-bit, 16-bit, 32-bit, 64-bit or of any other suitable architecture. The processor 1202 may include an arithmetic logic unit (ALU) for performing arithmetic and logic operations, processor registers that supply operands to the ALU and store the results of ALU operations, and a control unit that fetches instructions from memory 1204 and executes them by directing the coordinated operations of the ALU, registers, and other components. The processor may include other hardware and software that operates to process information, control the system 100, 500, 600, and perform any of the functions described herein (e.g., with respect to FIGS. 1-11). The processor 1202 is not limited to a single processing device and may encompass multiple processing devices. Similarly, the controller 140 is not limited to a single controller but may encompass multiple controllers.

The memory 1204 comprises one or more disks, tape drives, or solid-state drives, and may be used as an over-flow data storage device, to store programs when such programs are selected for execution, and to store instructions and data that are read during program execution. The memory 1204 may be volatile or non-volatile and may comprise ROM, RAM, ternary content-addressable memory (TCAM), dynamic random-access memory (DRAM), and static random-access memory (SRAM). The memory 1204 is operable to store temperature setpoint 142, measured temperatures 144, control rules 146, threshold values 1214, and any other data or instructions. The control rules 146 include high temperature mode instructions 1208, low temperature mode instructions 1210, and intermediate temperature instructions 1212. Each set of instructions 1208, 1210, 1212 includes any suitable set of logic, rules, or code operable to execute the operations described above with respect to FIGS. 1-11.

The I/O interface 1206 is configured to communicate data and signals with other devices. For example, the I/O interface 1206 may be configured to communicate electrical signals with the components of the systems 100, 500, 600, as described above and illustrated in FIGS. 1-7. The I/O interface may receive, for example, setpoint temperature 142, temperature measurements 144, environmental conditions, and the like and send electrical signals to the valves 124, 126, 128, 130, 132, 606, compressor 102, coolant pump 112, and any other appropriate system components. The I/O interface 1206 may use any suitable type of communication protocol to communicate with various components of the systems 100, 500, 600. For example, the I/O interface 1206 may be configured to transmit pulse width modulation (PWM) signals. In other examples, the I/O interface 1206 may use any other suitable type of signals to control components as would be appreciated by one of ordinary skill in the art. The I/O interface 1206 may comprise ports or terminals for establishing signal communications between the controller 140 and other devices. The I/O interface 1206 may be configured to enable wire and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A system comprising:

a first set of coils configured to:
- receive a coolant from a first coolant line;
- transfer heat from the coolant to outdoor air; and
- provide the coolant to a second coolant line;

a second set of coils configured to:
- receive the coolant from a third coolant line, wherein the third coolant line is disposed in series with and coupled to the first coolant line;
- transfer heat from the coolant to outdoor air; and
- provide the coolant to a fourth coolant line, wherein the fourth coolant line is disposed in series with and coupled to the second coolant line;

a water condenser disposed upstream of both the first set of coils and the second set of coils configured to provide the coolant to the first coolant line;

a first valve configured to regulate a flow of the coolant between the first coolant line and the third coolant line, the first valve being disposed between the first coolant line and the third coolant line;

a second valve configured to regulate the flow of the coolant between the second coolant line and the fourth coolant line, the second valve being disposed between the second coolant line and the fourth coolant line;

a third valve positioned and configured to regulate the flow of the coolant between the fourth coolant line and a fifth coolant line, wherein the fifth coolant line is coupled to a water evaporator and a three-way valve;

the three-way valve configured to regulate the flow of the coolant between the fifth coolant line, the third coolant line, and a coolant input line;

a fourth valve positioned upstream of the water condenser and between a coolant pump and the second coolant line, wherein the fourth valve is configured to regulate the flow of the coolant from the second coolant line to the water condenser; and a controller coupled to the first valve, second valve, third valve, fourth valve, and three-way valve, the controller comprising a processor configured to:
- receive an outdoor temperature and an indoor setpoint temperature;
- determine, based on a comparison of the outdoor temperature to the indoor setpoint temperature, that the system should operate in a high-temperature operating mode;
- after determining that the system should operate in the high-temperature operating mode:
  - cause the first valve to be in an open position such that the flow of the coolant is allowed between the first coolant line and the third coolant line;
  - cause the second valve to be in the open position such that the flow of the coolant is allowed between the second coolant line and the fourth coolant line;
  - cause the third valve to be in a closed position such that the flow of the coolant is prevented between the fourth coolant line and the fifth coolant line;
  - cause the fourth valve to be in the open position such that the flow of the coolant is allowed between the second coolant line and the water condenser; and
  - cause the three-way valve to be in a position such that the flow of the coolant is:
    - allowed between the coolant input and the fifth coolant line; and
    - prevented between the coolant input and the third coolant line.

2. The system of claim 1, wherein the water condenser is configured to:
- receive coolant cooled by the first set of coils and the second set of coils; and
- transfer heat from refrigerant to the cooled coolant, thereby cooling the refrigerant.

3. The system of claim 1, wherein the water evaporator is configured to:
- receive refrigerant cooled by the water condenser; and
- transfer heat from the coolant received from the fifth coolant line to the cooled refrigerant.

4. The system of claim 1, wherein the processor is configured to determine that the system should operate in the high-temperature operating mode by:
- determining a difference between the outdoor air temperature and the indoor setpoint temperature; and
- determining that the difference is greater than a predefined threshold value.

5. The system of claim 1, further comprising:
- a heat recovery unit configured to receive heated coolant from an outlet of the water condenser; and
- a second three-way valve positioned and configured to regulate the flow of the coolant between an output of the water condenser, the first coolant line, and an input of the heat recovery unit.

6. The system of claim 5, wherein the processor is further configured to:
- determine that a temperature of the heated coolant provided to the heat recovery unit is less than a first threshold temperature;
- in response to determining that the temperature of the heated coolant provided to the heat recovery unit is less than the first threshold temperature:
  - cause each of the first valve, second valve, and fourth valve to move to the closed position; and
  - cause the second three-way valve to be in a position such that coolant received from output of the water condenser is provided to the input of the heat recovery unit but is not allowed to flow to the first coolant line.

7. The system of claim 5, wherein the processor is further configured to:

determine that a temperature of the heated coolant provided to the heat recovery unit is greater than a first threshold temperature but less than a second threshold value;

in response to determining that the temperature of the heated coolant provided to the heat recovery unit is greater than the first threshold temperature but less than the second threshold value:

cause each of the first valve and the second valve to move to the closed position; and cause the second three-way valve to be in a position such that coolant received from the output of the water condenser is provided to the input of the heat recovery unit and is allowed to flow to the first coolant line.

8. A method of operating a combined chiller/free cooling system, the method comprising:

receiving an outdoor temperature and an indoor setpoint temperature;

determining, based on a comparison of the outdoor temperature to the indoor setpoint temperature, that the combined chiller/free cooling system should operate in a high-temperature operating mode, wherein the combined chiller/free cooling system comprises:

a first set of coils configured to:

receive a coolant from a first coolant line;

transfer heat from the coolant to outdoor air; and provide the coolant to a second coolant line;

a second set of coils configured to:

receive the coolant from a third coolant line, wherein the third coolant line is disposed in series with and coupled to the first coolant line;

transfer heat from the coolant to outdoor air; and provide the coolant to a fourth coolant line, wherein the fourth coolant line is disposed in series with and coupled to the second coolant line; and a water condenser disposed upstream of both the first set of coils and the second set of coils configured to provide the coolant to the first coolant line;

after determining that the combined chiller/free cooling system should operate in the high-temperature operating mode:

causing a first valve to be in an open position such that a flow of the coolant is allowed between the first coolant line and the third coolant line, the first valve being disposed between the first coolant line and the third coolant line;

causing a second valve to be in the open position such that the flow of the coolant is allowed between the second coolant line and the fourth coolant line, the second valve being disposed between the second coolant line and the fourth coolant line;

causing a third valve to be in a closed position such that the flow of the coolant is prevented between the fourth coolant line and a fifth coolant line, wherein the fifth coolant line is coupled to a water evaporator and a three-way valve;

causing a fourth valve to be in the open position such that the flow of the coolant is allowed from the second coolant line to the water condenser, wherein the fourth valve is disposed upstream of the water condenser and between a coolant pump and the second coolant line; and causing the three-way valve to be in a position such that the flow of the coolant is:

allowed between a coolant input of the combined chiller/free cooling system and the fifth coolant line; and prevented between the coolant input and the third coolant line.

9. The method of claim 8, further comprising:

receiving, by the water condenser, coolant cooled by the first set of coils and the second set of coils; and transferring, by the water condenser, heat from refrigerant to the cooled coolant, thereby cooling the refrigerant.

10. The method of claim 8, further comprising:

receiving, by the water evaporator, refrigerant cooled by the water condenser; and transferring, by the water evaporator, heat from the coolant received from the fifth coolant line to the cooled refrigerant.

11. The method of claim 8, further comprising determining that the combined chiller/free cooling system should operate in the high-temperature operating mode by:

determining a difference between the outdoor air temperature and the indoor setpoint temperature; and determining that the difference is greater than a predefined threshold value.

12. The method of claim 8, further comprising:

determining that a temperature of heated coolant provided to a heat recovery unit coupled to the combined chiller/free cooling system is less than a first threshold temperature;

in response to determining that the temperature of the heated coolant provided to the heat recovery unit is less than the first threshold temperature:

causing each of the first valve, second valve, and fourth valve to move to the closed position; and causing a second three-way valve to be in a position such that coolant received from an output of the water condenser is provided to an input of the heat recovery unit but is not allowed to flow to the first coolant line.

13. The method of claim 8, further comprising:

determining that a temperature of heated coolant provided to a heat recovery unit of the combined chiller/free cooling system is greater than a first threshold temperature but less than a second threshold value;

in response to determining that the temperature of the heated coolant provided to the heat recovery unit is greater than the first threshold temperature but less than the second threshold value:

causing each of the first valve and the second valve to move to the closed position; and causing a second three-way valve to be in a position such that coolant received from an output of the water condenser is provided to an input of the heat recovery unit and is allowed to flow to the first coolant line.

14. A controller of a combined chiller/free cooling system comprising a first set of coils configured to receive a coolant from a first coolant line, transfer heat from the coolant to outdoor air, and provide the coolant to a second coolant line; and a second set of coils configured to receive the coolant from a third coolant line, wherein the third coolant line is disposed in series with and coupled to the first coolant line, transfer heat from the coolant to outdoor air, and provide the coolant to a fourth coolant line, wherein the fourth coolant line is disposed in series with and coupled to the second coolant line, the controller comprising:

an input/output interface communicatively coupled to:

a first valve configured to regulate a flow of the coolant between the first coolant line and the third coolant line, the first valve being disposed between the first coolant line and the third coolant line;

a second valve configured to regulate the flow of the coolant between the second coolant line and the fourth coolant line, the second valve being disposed between the second coolant line and the fourth coolant line;

a third valve positioned and configured to regulate the flow of the coolant between the fourth coolant line and a fifth coolant line, wherein the fifth coolant line is coupled to a water evaporator and a three-way valve;

the three-way valve configured to regulate the flow of the coolant between the fifth coolant line, the third coolant line, and a coolant input line;

a fourth valve positioned upstream of a water condenser and between a coolant pump and the second coolant line, wherein the fourth valve is configured to regulate the flow of the coolant from the second coolant line to the water condenser; and a compressor configured to compress a refrigerant provided to the water condenser; and a processor communicatively coupled to the input/output interface and configured to:

receive an outdoor temperature and an indoor setpoint temperature;

determine, based on a comparison of the outdoor temperature to the indoor setpoint temperature, that the system should operate in a high-temperature operating mode;

after determining that the system should operate in the high-temperature operating mode:

cause the first valve to be in an open position such that the flow of the coolant is allowed between the first coolant line and the third coolant line;

cause the second valve to be in the open position such that the flow of the coolant is allowed between the second coolant line and the fourth coolant line;

cause the third valve to be in a closed position such that the flow of the coolant is prevented between the fourth coolant line and the fifth coolant line;

cause the fourth valve to be in the open position such that the flow of the coolant is allowed between the second coolant line and the water condenser; and cause the three-way valve to be in a position such that the flow of the coolant is:

allowed between the coolant input and the fifth coolant line; and prevented between the coolant input and the third coolant line.

15. The controller of claim 14, wherein the water condenser is configured to:

receive the coolant cooled by the first set of coils and the second set of coils; and transfer heat from the refrigerant to the cooled coolant, thereby cooling the refrigerant.

16. The controller of claim 14, wherein the water evaporator is configured to:

receive the refrigerant cooled by the water condenser; and transfer heat from the coolant received from the fifth coolant line to the cooled refrigerant.

17. The controller of claim 14, wherein the processor is configured to determine that the system should operate in the high-temperature operating mode by:

determining a difference between the outdoor air temperature and the indoor setpoint temperature; and determining that the difference is greater than a predefined threshold value.

18. The controller of claim 14, wherein the combined chiller/free cooling system further comprises:

a heat recovery unit configured to receive a heated coolant from an outlet of the water condenser; and a second three-way valve positioned and configured to regulate flow of the coolant between an output of the water condenser, the first coolant line, and an input of the heat recovery unit.

19. The controller of claim 18, wherein the processor is further configured to:

determine that a temperature of the heated coolant provided to the heat recovery unit is less than a first threshold temperature;

in response to determining that the temperature of the heated coolant provided to the heat recovery unit is less than the first threshold temperature:

cause each of the first valve, second valve, and fourth valve to move to the closed position; and cause the second three-way valve to be in a position such that the coolant received from the output of the water condenser is provided to the input of the heat recovery unit but is not allowed to flow to the first coolant line.

20. The controller of claim 18, wherein the processor is further configured to:

determine that a temperature of the heated coolant provided to the heat recovery unit is greater than a first threshold temperature but less than a second threshold value;

in response to determining that the temperature of the heated coolant provided to the heat recovery unit is greater than the first threshold temperature but less than the second threshold value:

cause each of the first valve and the second valve to move to the closed position; and cause the second three-way valve to be in a position such that the coolant received from the output of the water condenser is provided to the input of the heat recovery unit and is allowed to flow to the first coolant line.

* * * * *